US005652079A

United States Patent [19]

Mochizuki et al.

[11] Patent Number: 5,652,079

[45] Date of Patent: Jul. 29, 1997

[54] CARRIER FOR DRY TWO-COMPONENT DEVELOPER AND METHOD OF PRODUCING THE SAME

[75] Inventors: Satoshi Mochizuki, Numazu; Fumihiro Sasaki, Fuji; Hidefumi Gohhara, Numazu; Norio Yokoyama; Yutaka Sakai, both of Nagoya; Takahisa Kato, Mishima; Tohru Suganuma, Numazu; Susumu Kawakami; Hironori Hata, both of Nagoya, all of Japan

[73] Assignee: Ricoh Company, Ltd., Tokyo, Japan

[21] Appl. No.: 568,429

[22] Filed: Dec. 6, 1995

[30] Foreign Application Priority Data

Dec. 6, 1994 [JP] Japan ..... 6-329815
Nov. 29, 1995 [JP] Japan ..... 7-333993

[51] Int. Cl.[6] ..... G03G 9/113

[52] U.S. Cl. ..... 430/108; 430/137

[58] Field of Search ..... 430/106, 108, 430/137

[56] References Cited

U.S. PATENT DOCUMENTS 5,225,302 7/1993 Isoda et al. ..... 430/106.6
5,254,525 10/1993 Nakajima et al. ..... 428/204
5,397,668 3/1995 Sato et al. ..... 430/108
5,514,509 5/1996 Kawata et al. ..... 430/108

*Primary Examiner*—John Goodrow

*Attorney, Agent, or Firm*—Oblon, Spivak, McClelland, Maier & Neustadt, P.C.

[57] ABSTRACT

A carrier for a dry two-component developer, includes a core material and a silicone-modified acrylic resin layer coated on the surface of the core material, the silicone-modified acrylic resin layer including a silicone-modified acrylic resin, with the ratio of the percentage transmission of infrared spectrum Si—O stretching vibrations ($T_{Si}$) of the silicone-modified acrylic resin layer to the percentage transmission of infrared spectrum C=O stretching vibrations ($T_C$) thereof, $T_{Si}/T_C$, being at least 1.0. The silicone-modified acrylic resin layer can be made from a water-soluble synthetic resin solution containing a silicone macromonomer (A) with a vinyl group being introduced into one terminal thereof, and a vinyl monomer (B) which is copolymerizable with the silicone macromonomer (A), with the molecular weight of the silicone macromonomer (A) of the silicone-modified acrylic resin being in the range of 1,000 to 10,000. Methods of producing such carriers are provided.

104 Claims, 1 Drawing Sheet

CARRIER FOR DRY TWO-COMPONENT DEVELOPER AND METHOD OF PRODUCING THE SAME

BACKGROUND OF THE INVENTION

1. Field of the Invention

The present invention relates to a carrier for a dry two-component developer which is employed in electrophotography, electrostatic recording and electrostatic printing, and also to a method of producing the carrier.

2. Discussion of Background

Conventionally a cascade development method as disclosed in U.S. Pat. No. 2,618,552 and a magnetic brush development method as disclosed in U.S. Pat. No. 2,874,063 are known as methods for developing latent electrostatic images to visible images by use of toner. In any of these development methods, a dry two-component developer is employed.

Such a dry two-component developer is composed of relatively large carrier particles and fine toner particles which are triboelectrically held on the surface of the relatively large carrier particles by the electric force generated by the friction between the carrier particles and toner particles. When such a dry two-component developer is brought near latent electrostatic images, the toner particles are attracted to the latent electrostatic images, with the bonding force between the carrier particles and the toner particles being overcome by the attracting force of the electric field formed by the latent electrostatic images for bringing the toner particles towards the electrostatic images, so that the toner particles are deposited on the latent electrostatic images, whereby the latent electrostatic images are developed to visible toner images. With the toner particles being replenished to the developer in accordance with the consumption thereof during the development, the developer is repeatedly used.

For the above-mentioned development, it is required that the toner particles be provided with accurate chargeability and charge quantity as to be selectively attracted to a desired image area formed on a photoconductor. Furthermore, it is required that the carrier be capable of always triboelectrically charging the toner particles to the desired polarity with a sufficient charge quantity for the formation of images with high quality over a long period of time.

However, in conventional developers, during the process of making a number of copies, there takes place a so-called "spent phenomenon" that a toner film is formed on the surface of the carrier particles by a collision between the toner particles and the carrier particles, or by a mechanical collision between such developer particles and mechanical portions of a development unit, or by the heat generated by such collision, so that the charging performance of the carrier particles is decreased and the toner particles are scattered while in use, causing the deposition of the toner particles on the background of the images and lowering the copy quality. When this spent phenomenon excessively develops, there occurs the case where the developer must be exchanged with a fresh developer in its entirety.

Frequent exchange of the developer would lead to an increase in the copy making cost, so that it has been proposed that the surface of carrier particles be coated with a resin having low surface energy such as silicone resin or fluorine-containing resin to prevent the occurrence of the spent phenomenon for extending the usable period of the developer without being exchanged, and such carrier particles are used in practice.

Such a resin-coated carrier is produced by dissolving a coating resin in a ketone such as acetone or methyl ethyl ketone, an aromatic hydrocarbon such as toluene or xylene, or an organic solvent such as dioxane or tetrahydrofuran to prepare a coating resin solution, and by coating a carrier core material with the thus prepared coating resin solution, for instance, by an immersing method or a spray coating method.

The organic solvents employed for the above-mentioned coating have relatively low boiling points, so that they have the risks of explosion and having adverse effects on human body if inhaled during the coating process. Furthermore, an apparatus for recovering used solvents is necessary, so that the production of such a resin-coated carrier will be costly.

From the viewpoint of the prevention of environmental pollution, a carrier coated with an aqueous polyurethane resin composition has been proposed as disclosed in Japanese Laid-Open Patent Application 5-127431.

Unquestionably, the use of the above-mentioned aqueous resin composition will reduce the risks of the explosion and adverse effects on human body during the production of the carrier, and will eliminate the necessity for recovering the solvent, resulting in the reduction of the production cost.

However, when the aqueous polyurethane resin composition is employed, its surface energy is so high that the carrier coated with the polyurethane resin is poor in the anti-spent phenomenon performance and therefore not suitable for use with a developer with high durability.

SUMMARY OF THE INVENTION

It is therefore a first object of the present invention to provide a resin-coated carrier for a dry two-component developer capable of faithfully reproducing original images, which resin-coated carrier is free from environmental pollution problems, has high durability and can be produced with high productivity at low cost.

A second object of the present invention is to provide a method of producing the above-mentioned resin-coated carrier.

The first object of the present invention can be achieved by a carrier for a dry two-component developer, comprising a core material and a silicone-modified acrylic resin layer coated on the surface of the core material, the silicone-modified acrylic resin layer comprising a silicone-modified acrylic resin, with the ratio of the percentage transmission of the Si—O stretching vibrations ($T_{Si}$) in the infrared spectrum of the silicone-modified acrylic resin layer to the percentage transmission of the C=O stretching vibrations ($T_C$) in the infrared spectrum thereof, $T_{Si}/T_C$, being at least 1.0.

In the above carrier, the silicone-modified acrylic resin for the silicone-modified acrylic resin layer may be made from a water-soluble synthetic resin solution comprising a silicone macromonomer (A) with a vinyl group being introduced into one terminal thereof, and a vinyl monomer (B) which is copolymerizable with the silicone macromonomer (A), with the molecular weight of the silicone macromonomer (A) of the silicone-modified acrylic resin being in the range of 1,000 to 10,000.

The above silicone-modified acrylic resin for the silicone-modified acrylic resin layer may also be made with the silicone macromonomer (A) and the vinyl monomer (B) being mixed with a parts-by-weight ratio in the range of (40:60) to (70:30).

The above silicone-modified acrylic resin may further be allowed to react with a water-soluble melamine resin by mixing the silicone-modified acrylic resin with the water-soluble melamine resin in a parts-by-weight ratio in the range of (100:2) to (100:5) for the formation of the silicone-modified acrylic resin layer.

The silicone-modified acrylic resin layer may be formed from an aqueous dispersion of synthetic resin particles, each particle comprising (1) a core layer comprising a polymer of a silicone macromonomer (A) with a vinyl group being introduced into one terminal thereof, and/or a vinyl monomer (B) which is copolymerisable with the silicone macromonomer (A), and (2) an outer shell which covers the core layer, comprising a copolymer of the silicone macromonomer (A) and the vinyl monomer (B) which is copolymerizable with the silicone macromonomer (A).

In the carrier with the above-mentioned silicone-modified acrylic resin layer, the core layer of the synthetic resin particles may have a glass transition temperature which is higher than the glass transition temperature of the outer shell thereof.

In the carrier with the above-mentioned silicone-modified acrylic resin layer, the amount of the silicone macromonomer (A) in the outer shell may be in the range of 50 to 100 parts by weight to 100 parts by weight of the entire amount of the silicone macromonomer (A) contained in polymer or copolymer of which the core layer and the outer shell are made.

In the carrier of the present invention, the silicone-modified acrylic resin for the silicone-modified acrylic resin layer may be formed from an aqueous dispersion A of synthetic resin particles, each particle comprising (1) a core layer comprising a polymer of a silicone macromonomer (A) with a vinyl group being introduced into one terminal thereof, and/or a vinyl monomer (B) which is copolymerizable with the silicone macromonomer (A), and (2) an outer shell which covers the core layer, comprising a copolymer of the silicone macromonomer (A) and the vinyl monomer (B) which is copolymerizable with the silicone macromonomer (A); and an aqueous resin solution B comprising a copolymer of the silicone macromonomer (A) and the vinyl monomer (B) which is copolymerizable with the silicone macromonomer (A), and the silicone-modified acrylic resin further comprising an electroconductive material.

The above-mentioned aqueous dispersion A and/or aqueous resin solution B may further comprise a water-soluble melamine resin.

The silicone macromonomer contained in the above aqueous dispersion A and/or aqueous resin solution B may comprise a polymethylene siloxane.

The silicone macromonomer contained in the above aqueous dispersion A and/or aqueous resin solution B may have a molecular weight in the range of 1,000 to 20,000.

In the above-mentioned carrier of the present invention, the core layer of the synthetic resin particles may have a glass transition temperature which is higher by at least 10° C. than the glass transition temperature of the outer shell thereof in the aqueous dispersion A.

The amount of the silicone macromonomer (A) in the outer shell in the synthetic resin particles contained in the aqueous dispersion A may be in the range of 50 to 100 parts by weight to 100 parts by weight of the entire amount of the silicone macromonomer (A) contained in the entire weight of the synthetic resin particles.

The first object of the present invention can also be achieved by an carrier for a dry two-component developer, comprising a core material and a silicone-modified acrylic resin layer coated on the surface of the core material, the silicone-modified acrylic resin layer comprising a silicone-modified acrylic resin which is made from a water-soluble synthetic resin solution comprising a silicone macromonomer (A) with a vinyl group being introduced into one terminal thereof, and a vinyl monomer (B) which is copolymerizable with the silicone macromonomer (A), with the molecular weight of the silicone macromonomer (A) of the silicone-modified acrylic resin being in the range of 1,000 to 10,000.

In the above carrier, the silicone-modified acrylic resin for the silicone-modified acrylic resin layer may be made with the silicone macromonomer (A) and the vinyl monomer (B) being mixed with a parts-by-weight ratio in the range of (40:60) to (70:30).

The silicone-modified acrylic resin may be further allowed to react with a water-soluble melamine resin by mixing the silicone-modified acrylic resin with the water-soluble melamine resin in a parts-by-weight ratio in the range of (100:2) to (100:5) for the formation of the silicone-modified acrylic resin layer.

The first object of the present invention can also be achieved by a carrier for a dry two-component developer, comprising a core material and a silicone-modified acrylic resin layer coated on the surface of the core material, the silicone-modified acrylic resin layer being formed from an aqueous dispersion of synthetic resin particles, each particle comprising (1) a core layer comprising a polymer of a silicone macromonomer (A) with a vinyl group being introduced into one terminal thereof, and/or a vinyl monomer (B) which is copolymerizable with the silicone macromonomer (A), and (2) an outer shell which covers the core layer, comprising a copolymer of the silicone macromonomer (A) and the vinyl monomer (B) which is copolymerizable with the silicone macromonomer (A).

In the above carrier, the core layer of the synthetic resin particles may have a glass transition temperature which is higher then the glass transition temperature of the outer shell thereof.

The amount of the silicone macromonomer (A) in the outer shell may be in the range of 50 to 100 parts by weight to 100 parts by weight of the entire amount of the silicone macromonomer (A) contained in the polymer or copolymer of which the core layer and the outer shell are made.

The silicone-modified acrylic resin may further be allowed to react with a water-soluble melamine resin by mixing the silicone-modified acrylic resin with the water-soluble melamine resin in a parts-by-weight ratio in the range of (100:2) to (100:5) for the formation of the silicone-modified acrylic resin layer.

The first object of the present invention can also be achieved by a carrier for a dry two-component developer, comprising a core material and a silicone-modified acrylic resin layer comprising a silicone-modified acrylic resin, which is coated on the surface of the core material, the silicone-modified acrylic resin being formed from an aqueous dispersion A of synthetic resin particles, each particle comprising (1) a core layer comprising a polymer of a silicone macromonomer (A) with a vinyl group being introduced into one terminal thereof, and/or a vinyl monomer (B) which is copolymerizable with the silicone macromonomer (A), and (2) an outer shell which covers the core layer, comprising a copolymer of the silicone macro-monomer (A) and the vinyl monomer (B) which is copolymerizable with the silicone macromonomer (A); and an aqueous resin solution B comprising a copolymer of the silicone macromonomer (A) and the vinyl monomer (B) which is copolymerizable with the silicone macro-monomer (A), and the silicone-modified acrylic resin further comprising an electroconductive material.

The above aqueous dispersion A and/or aqueous resin solution B may further comprise a water-soluble melamine resin.

The silicone macro-monomer contained in the aqueous dispersion A and/or aqueous resin solution B may comprise a polymethylene siloxane.

The silicone macromonomer contained in the aqueous dispersion A and/or aqueous resin solution B may have a molecular weight in the range of 1,000 to 20,000.

The core layer of the synthetic resin particles may have a glass transition temperature which is higher by at least 10° C. than the glass transition temperature of the outer shell thereof in the aqueous dispersion A.

The amount of the silicone macromonomer (A) in the outer shell in the synthetic resin particles contained in the aqueous dispersion A may be in the range of 50 to 100 parts by weight to 100 parts by weight of the entire amount of the silicone macromonomer (A) contained in the entire weight of the synthetic resin particles.

The first object of the present invention can also be achieved by a carrier for a dry two-component developer, comprising a core material and a silicone-modified acrylic resin layer coated on the surface of the core material, the silicone-modified acrylic resin layer comprising a silicone-modified acrylic resin which is made from a water-soluble synthetic resin solution comprising a silicone macromonomer (A) with a vinyl group being introduced into one terminal thereof, and a vinyl monomer (B) which is copolymerizable with the silicone macro-monomer (A), with the molecular weight of the silicone macromonomer (A) of the silicone-modified acrylic resin being in the range of 1,000 to 10,000; and an electroconductive material.

In the above carrier, the silicone-modified acrylic resin for the silicone-modified acrylic resin layer is made with the silicone macromonomer (A) and the vinyl monomer (B) being mixed with a parts-by-weight ratio in the range of (40:60) to (70:30).

The silicone-modified acrylic resin may further be allowed to react with a water-soluble melamine resin by mixing the silicone-modified acrylic resin with the water-soluble melamine resin in a parts-by-weight ratio in the range of (100:2) to (100:5) for the formation of the silicone-modified acrylic resin layer.

The second object of the present invention can be achieved by a method of producing a carrier for a dry two-component developer, the carrier comprising a core material and a silicone-modified acrylic resin layer coated on the surface of the core material, the silicone-modified acrylic resin layer comprising a silicone-modified acrylic resin and finely-divided electroconductive particles, comprising the steps (1) to (4) of:

(1) preparing a water-soluble silicone-modified acrylic resin solution B comprising a copolymer of a silicone macromonomer (A) with a vinyl group being introduced into one terminal thereof, and a vinyl monomer (B) which is copolymeriz-able with the silicone macromonomer (A);

(2) dispersing finely-divided electroconductive particles in the water-soluble silicone-modified acrylic resin solution B obtained in the step (1);

(3) preparing an aqueous dispersion A of synthetic resin particles, each particle comprising (1) a core layer comprising a polymer of the silicone macromonomer (A) and/or the vinyl monomer (B), and (2) an outer shell which covers the core layer, comprising a polymer of the silicone macromonomer (A) or a copolymer of the silicone macro-monomer (A) and the vinyl monomer (B) which is copolymerizable with the silicone macromonomer (A);

(4) mixing the aqueous dispersion A obtained in the step (3) with the water-soluble silicone-modified acrylic resin solution B which contains the finely-divided electroconductive particles, which is obtained in the step (2) to prepare a coating liquid for the formation of a silicone-modified acrylic resin layer; and coating the surface of the core material with the coating liquid obtained in the step (4).

In the above method, there may be added a step (5) of subjecting the surface of the core material coated with the coating liquid obtained in step (4) to heat treatment at 150° C. or more.

The second object of the present invention may also be achieved by a method of producing a carrier for a dry two-component developer, the carrier comprising a core material and a silicone-modified acrylic resin layer coated on the surface of the core material, the silicone-modified acrylic resin layer comprising a silicone-modified acrylic resin with the ratio of the percentage transmission of the Si—O stretching vibrations ($T_{Si}$) in the infrared spectrum of the silicone-modified acrylic resin layer to the percentage transmission of the C=O stretching vibrations ($T_C$) in the infrared spectrum thereof, $T_{Si}/T_C$, being at least 1.0, comprising the steps of:

coating the surface of the core material with the silicone-modified acrylic resin; and subjecting the surface of the core material coated with the silicone-modified acrylic resin to heat treatment at 150° C. or more.

The second object of the present invention can also be achieved by a method of producing a carrier for a dry two-component developer, the carrier comprising a core material and a silicone-modified acrylic resin layer coated on the surface of the core material, the silicone-modified acrylic resin layer comprising a silicone-modified acrylic resin which is made from a water-soluble synthetic resin solution comprising a silicone macromonomer (A) with a vinyl group being introduced into one terminal thereof, and a vinyl monomer (B) which is copolymerizable with the silicone macro-monomer (A), with the molecular weight of the silicone macromonomer (A) of the silicone-modified acrylic resin being in the range of 1,000 to 10,000, comprising the steps of:

coating the surface of the core material with the silicone-modified acrylic resin; and subjecting the surface of the core material coated with the silicone-modified acrylic resin to heat treatment at 150° C. or more.

The second object of the present invention can be achieved by a method of producing a carrier for a dry two-component developer, the carrier comprising a core material and a silicone-modified acrylic resin layer coated on the surface of the core material, the silicone-modified acrylic resin layer being formed from an aqueous dispersion of synthetic resin particles, each particle comprising (1) a core layer comprising a polymer of a silicone macromonomer (A) with a vinyl group being introduced into one terminal thereof, and/or a vinyl monomer (B) which is copolymeriz-able with the silicone macromonomer (A), and (2) an outer shell which covers the core layer, comprising a copolymer of the silicone macromonomer (A) and the vinyl monomer (B) which is copolymerizable with the silicone macromonomer (A), comprising the steps of:

coating the surface of the core material with the silicone-modified acrylic resin; and subjecting the surface of the core material coated with the silicone-modified acrylic resin to heat treatment at 150° C. or more.

The second object of the present invention can also be achieved by a method of producing a carrier for a dry two-component developer, the carrier comprising a core material and a silicone-modified acrylic resin layer comprising a silicone-modified acrylic resin, which is coated on the surface of the core material, the silicone-modified acrylic resin being formed from:

an aqueous dispersion A of synthetic resin particles, each particle comprising (1) a core layer comprising a polymer of a silicone macromonomer (A) with a vinyl group being introduced into one terminal thereof, and/or a vinyl monomer (B) which is copolymeriz-able with the silicone macromonomer (A), and (2) an outer shell which covers the core layer, comprising a copolymer of the silicone macro-monomer (A) and the vinyl monomer (B) which is copolymerizable with the silicone macromonomer (A); and an aqueous resin solution B comprising a copolymer of the silicone macromonomer (A) and the vinyl monomer (B) which is copolymeriz-able with the silicone macromonomer (A), and the silicone-modified acrylic resin further comprising an electroconductive material, comprising the steps of:

coating the surface of the core material with the silicone-modified acrylic resins; and subjecting the surface of the core material coated with the silicone-modified acrylic resin to heat treatment at 150° C. or more.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawing, wherein.

DESCRIPTION OF THE PREFERRED EMBODIMENTS

Figure 1:
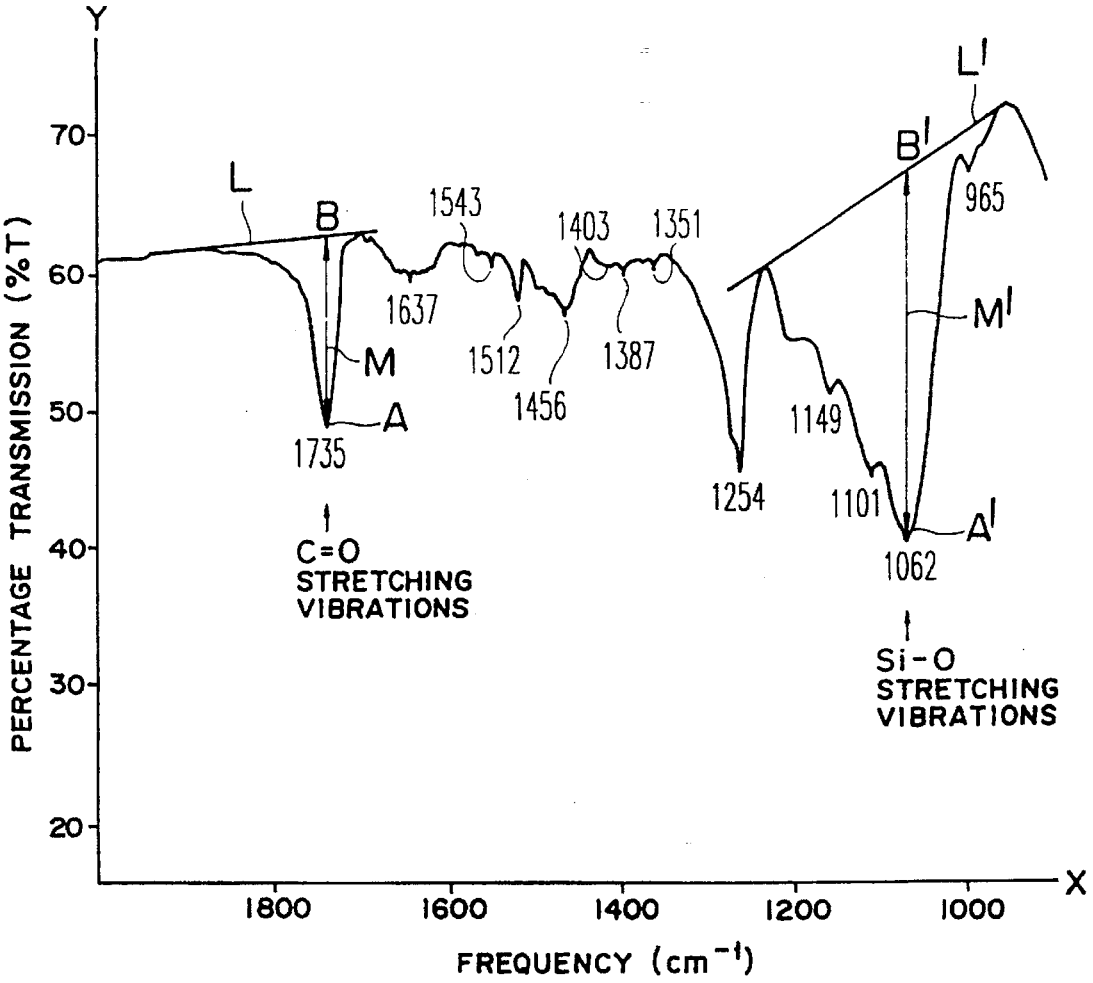
FIG. 1 is a diagram for determining the ratio of the percentage transmission of the Si—O stretching vibrations ($T_{Si}$) in the infrared spectrum of a silicone-modified acrylic resin layer for use in the present invention to the percentage transmission of the C=O stretching vibrations ($T_C$) in the infrared spectrum thereof, $T_{Si}/T_C$.

A carrier for a dry two-component developer of the present invention comprises a core material and a silicone-modified acrylic resin layer coated on the surface of the core material, the silicone-modified acrylic resin layer comprising a silicone-modified acrylic resin, with the ratio of the percentage transmission of the Si—O stretching vibrations ($T_{Si}$) in the infrared spectrum of the silicone-modified acrylic resin layer to the percentage transmission of the C=O stretching vibrations ($T_C$) in the infrared spectrum thereof, $T_{Si}/T_C$, being at least 1.0.

The above carrier has high stability in chargeability.

The above-mentioned ratio of the percentage transmission of the Si—O stretching vibrations ($T_{Si}$) in the infrared spectrum of the silicone-modified acrylic resin layer to the percentage transmission of the C=O stretching vibrations ($T_C$) in the infrared spectrum thereof, $T_{Si}/T_C$, can be determined by use of an infrared spectrophotometer in general use as follows:

A predetermined amount of a sample carrier is added to chloroform, and the mixture thereof is dispersed in an ultrasonic vibration container. The supernatant solution of the mixture is coated on the surface of a KBr pellet and then dried.

An infrared spectrum of the supernatant-solution-coated KBr pellet is obtained, for instance, as shown in FIG. 1.

With reference to FIG. 1, a straight base line L is determined by tangentially connecting the tops of the two shoulders of the curve on the opposite sides of the C=O absorption peak A. A straight line M, which starts from the C=O absorption peak A towards the base line L and runs in parallel with the Y axis, is drawn to obtain a cross point B with the base line L. The distance between the C=O absorption peak A and the cross point B on the straight line M is determined as the percentage transmission of the C=O stretching vibrations ($T_C$) in the infrared spectrum of the silicone-modified acrylic resin layer.

The percentage transmission of the Si—O stretching vibrations ($T_{Si}$) in the infrared spectrum of the silicone-modified acrylic resin layer can also be obtained in the same manner as mentioned above. In the diagram, a straight line L' is a base line for the Si—O stretching vibrations, a point A' is the Si—O absorption peak, a straight line M' corresponds to the previously mentioned straight line M for the C=O stretching vibrations ($T_C$), and a point B' is the cross point of the base line L' and the straight line M'. The distance between the Si—O absorption peak A' and the cross point B' on the straight line M' is determined as the percentage transmission of the Si—O stretching vibrations ($T_{Si}$) in the infrared spectrum of the silicone-modified acrylic resin layer.

The silicone-modified acrylic resin layer which serves as a coating layer will now be explained.

The carrier according to the present invention can be prepared by forming a coating layer which is prepared from an aqueous dispersion A of synthetic resin particles, each particle comprising (1) a core layer comprising a polymer of a silicone macromonomer (A) with a vinyl group being introduced into one terminal thereof, end/or a vinyl monomer (B) which is copolymerizable with the silicone macromonomer (A), and (2) an outer shell which covers the core layer, comprising a copolymer of the silicone macromonomer (A) and the vinyl monomer (B) which is copolymerizable with the silicone macromonomer (A); or from an water-soluble synthetic solution B comprising a silicone macromonomer (A) with a vinyl group being introduced into one terminal thereof, and a vinyl monomer (B) which is copolymerizable with the silicone macromonomer (A), with the molecular weight of the silicone macromonomer (A) of the silicone-modified acrylic resin being in the range of 1,000 to 10,000.

The above carrier has high environmental safety and high durability and can be produced at low cost, with high productivity.

The above features can be further improved by use of the core layer with a glass transition temperature which is higher than the glass transition temperature of the outer shell thereof, preferably higher by at least 10° C.; or with the amount of the silicone macro-monomer (A) in the outer shell being set in the range of 50 to 100 parts by weight to 100 parts by weight of the entire amount of the silicone macromonomer (A) contained in the synthetic resin particles; or with a water-soluble melamine resin being contained in the above-mentioned silicone-modified acrylic resin.

Furthermore, by containing finely-divided electroconductive materials in the coating layer, the resistivity of the carrier can be controlled, so that it is possible to obtain high quality images. However, if such finely-divided electroconductive materials are mixed with the aqueous dispersion A of synthetic resin particles comprising the core layer and the outer shell, the synthetic resin particles are adsorbed by the finely-divided electroconductive materials, so that the synthetic resin particles lose the function as a coating material. Therefore, it is preferable that such finely-divided electroconductive materials be dispersed in the water-soluble resin solution B, or that the finely-divided electroconductive materials be dispersed in the water-soluble resin solution be and then the aqueous dispersion A be mixed therewith for the preparation of the above-mentioned carrier.

As mentioned previously, in the present invention, there is employed an aqueous dispersion A of synthetic resin particles, each particle comprising (1) a core layer comprising a polymer of a silicone macromonomer (A) with a vinyl group being introduced into one terminal thereof, and/or a vinyl monomer (B) which is copolymerizable with the silicone macromonomer (A), and (2) an outer shell which covers the core layer, comprising a copolymer of the silicone macromonomer (A) and the vinyl monomer (B) which is copolymerizable with the silicone macromonomer (A); an water-soluble synthetic solution B comprising a silicone macromonomer (A) with a vinyl group being introduced into one terminal thereof, and a vinyl monomer (B) which is copolymerizable with the silicone macromonomer (A), with the molecular weight of the silicone macromonomer (A) of the silicone-modified acrylic resin being in the range of 1,000 to 10,000.

[Silicone Macromonomer (A)]

The silicone macromonomer (A) for use in the present invention has a structure with one of the following formula (I) or (II):

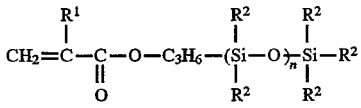

(I)

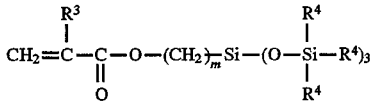

(II)

wherein $R^1$ and $R^3$ are each a hydrogen atom or methyl group; $R^2$ and $R^4$ are each phenyl group, methyl group or ethyl group; n is an integer of 10 to 400; and m is an integer of 1 or more.

Two or more of the above silicone macromonomers may be used in combination in the present invention.

[Vinyl Monomer (B)]

The vinyl monomer (B) for use in the present invention is copolymerizable with the above-mentioned silicone macromonomer (A).

Examples of the vinyl monomer (B) include methyl acrylate, ethyl acrylate, n-butyl acrylate, iso-butyl acrylate, 2-ethylhexyl acrylate, cyclohexyl acrylate, tetrahydrofurfuryl acrylate, methyl methacrylate, ethyl methacrylate, n-butyl methacrylate, iso-butyl methacrylate, 2-ethylhexyl methacrylate, stearyl methacrylate, lauryl methacrylate, methyl vinyl ether, ethyl vinyl ether, n-propyl vinyl ether, n-butyl vinyl ether, iso-butyl vinyl ether, styrene, α-methylstyrene, acrylonitrile, methacrylonitrile, vinyl acetate, vinyl chloride, vinylidene chloride, vinyl fluoride, vinylidene fluoride, 2-hydroxyethyl acrylate, 2-hydroxyethyl methacrylate, 2-hydroxypropyl acrylate, 2-hydroxypropyl methacrylate, allyl alcohol, glycidyl acrylate, glycidyl methacrylate, glycidyl allyl ether, acrylic acid, mathacrylic acid, itaconic acid, crotonic acid, maleic acid, maleic anhydride, citraconic acid, acrylamide, methacrylamide, N-methylolacrylamide, N-methylolmethacrylamide, dimethylamino ethylacrylate, ethylene, propylene, chloroprene and butadiene.

The two or more of the above vinyl monomers may also be used in combination.

[Synthetic Resin Particles]

In the present invention, when a coating layer is formed from the aqueous dispersion A, the mixing ratio of the above-mentioned silicone macromonomer (A) to the above-mentioned vinyl monomer (B) is usually set in the range of (95:5) to (5:95). Furthermore, the weight ratio of the core layer to the outer shell is usually set in the range of (10:90) to (90:10). The weight ratio of the silicone macromonomer (A) in the copolymer of which the outer shell is formed is usually set in the range of 50 to 100 to 100 of the entire amount of the silicone macromonomer (A) contained in the weight of the polymer or the copolymer of which the core layer and the outer shell are made.

The glass transition temperature (Tg) of the core layer of the synthetic resin particles for use in the present invention is usually set at 25° C. or more, preferably at 30° C. or more, while the glass transition temperature (Tg) of the outer shell is usually set at 15° C. or less, preferably at 10° C. or less. These glass transition temperatures can be adjusted by appropriate choice of the kinds of the silicone macromonomer (A) and vinyl monomer (B), and by changing the composition of the copolymer.

Further, it is particularly preferable that the above silicone-modified acrylic resin particles be allowed to react with a water-soluble melamine resin by mixing the silicone-modified acrylic resin particles with the water-soluble melamine resin in a parts-by-weight ratio in the range of (100:2) to (100:5) for improving the durability and other characteristics of the coated carrier of the present invention.

[Preparation of Aqueous Dispersion of Synthetic Resin Particles]

The aqueous dispersion of the synthetic resin particles for use in the present invention can be prepared by emulsion polymerization. The outline of the emulsion polymerization is as follows:

A monomer or a mixture of monomers for the preparation of the polymer or copolymer for the formation of the core layer is dispersed in water with the addition of a surfactant thereto. The monomer or the mixture of monomers is then subjected to emulsion polymerization in the presence of a water-soluble initiator to prepare core layers.

A monomer or a mixture of monomers for the preparation of the polymer or copolymer for the formation of the outer shell is dispersed in the above emulsified polymer mixture and subjected to emulsion polymerization in the presence of a water-soluble initiator with the addition of the same surfactant as employed in the above-mentioned emulsion polymerization or with the addition of a different surfactant thereto, whereby an outer shell is formed on the outer surface of each core layer, whereby an aqueous dispersion of synthetic resin particles, each being composed of the core layer and the outer shell, is prepared.

[Surfactants]

Surfactants which are used in the preparation of the above-mentioned aqueous dispersion of synthetic resin particles for use in the present invention are conventional anionic surfactants, nonionic and cationic surfactants.

Examples of the anionic surfactant include higher alcohol sulfate (sodium salt or amine salt), alkylarylsulfonate (sodium salt), alkylnaphthalenesulfonate, alkylnaphthalenesulfonate condensate, alkyl phosphate, dialkylsulfosuccinate and rosined soap.

Examples of the nonionic surfactant include polyoxyethylene alkyl ether, polyoxyethylene alkylphenol ether, polyoxyethylene alkyl ester, polyoxyethylene alkylamine, polyoxyethylene alkylamide, sorbitan alkyl ester and polyoxyethylene sorbitan alkyl ester.

Examples of the cationic surfactant include trimethylaminoethyl alkyl amide halogenide, alkylpyridinumsulfate, and alkyltrimethylammonium halogenide.

These surfactants may be used alone or in combination. The present invention is not limited to the above surfactants with respect to the use thereof.

The amount of such a surfactant is generally in the range of about 0.1 to 10 parts by weight to 100 parts by weight of the above-mentioned monomer or monomer mixture.

The amount of water to be used as polymerization solvent is in the range of about 30 to 100 parts by weight.

[Water-soluble Initiators]

Examples of the water-soluble initiator to be employed for the preparation of the aqueous dispersion of the synthetic resin particles for use in the present invention include inorganic peroxides such as ammonium persulfate, potassium persulfate, sodium persulfate, sodium perborate and hydrogen peroxide; organic peroxides such as cumene hydroperoxide, tertiary butyl peroximaleic acid, succinic acid peroxide and tertiary butyl hydroperoxide; and azo compounds such as 2,2'-azobis[2-(N-benzylamidino) propane]dihydrochloride, 2,2'-azobis[2-(N-arylamidino) propane]dihydrochloride 2,2'-azobis(2-amidinopropane) dihydrochloride, 2,2'-azobis[2-{N-(2-hydroxyethyl) amidino}propane]dihydrochloride, 2,2'-azobis[2-methyl-N-[1,1-bis(hydroxymethyl)-2-hydroxyethyl]propionamide, and 2,2'-azobis[2-methyl-N-(2-hydroxyethyl)] propionamide.

There can be also employed redox initiator systems, which may be formed in combination of a reducing agent such as sodium sulfite, sodium bisulfite, sodium hyposulfite, or sodium ascorbate, with the above water-soluble initiators. Two or more of each of the above-mentioned water-soluble initiators and reducing agents may be used in combination.

The present invention is not limited to the above-mentioned initiators with respect to the use thereof.

[Emulsion Polymerization]

When the polymer or copolymer for the preparation of the core layer and the outer shell is produced by emulsion polymerization, the concentration of a monomer or a monomer mixture is usually about in the range of 20 to 60 wt. % in the emulsion polymerization system. The concentration of any of the above-mentioned water-soluble initiators is usually in the range of about 0.01 to 5 parts by weight to 100 parts by weight of the above-mentioned monomer or monomer mixture.

The emulsion polymerization can be carried out by any of the following three methods:

"En bloc" method in which water and a surfactant are placed in a reactor, and the above-mentioned monomer or monomer mixture is also placed en bloc, and the emulsion polymerization is carried out by use of a water-soluble initiator;

Divisional method in which the above-mentioned monomer or monomer mixture is divided into several portions, and the divided portions are separately placed in the reactor and the emulsion polymerization is carried out by use of the water-soluble initiator; and Continuous method in which the above-mentioned monomer or monomer mixture is added dropwise continuously to the reactor over a predetermined period of time.

Alternatively, a predetermined amount of the above-mentioned monomer or monomer mixture may be emulsified in a predetermined amount of an aqueous solution of any of the previously mentioned surfactants to prepare a preparatory emulsion, and the thus prepared preparatory emulsion may be poured into the reactor by any of the above-mentioned single lot method, divisional method and continuous method.

In the above-mentioned emulsion polymerization, the surfactant and the water-soluble initiator for the preparation of the core layer may be respectively the same as or different from the surfactant and the water-soluble initiator for the preparation of the outer shell.

Furthermore, in the preparation of the core layer and in the preparation of the outer shell, the same method or a different method may be employed for pouring the monomer or monomer mixture into the reactor.

The temperature for the above emulsion polymerization may be appropriately set in accordance with the kinds of the monomer and the water-soluble initiator to be employed, but is generally set in the range of 30° to 90° C.

[Third Components]

A third component may optionally be added to the aqueous dispersion of the synthetic resin particles for use in the present invention.

Examples of such a third component include cross linking agents such as water-soluble epoxy resin, water-soluble block isocyanate and compounds having hydrolyzable silyl group; fillers such as calcium carbonate, titanium oxide, iron oxide, chromium oxide, blast furnace slag and fly ash; protective colloids or viscosity increasing agents such as polyvinyl alcohol, methyl cellulose, carboxymethyl cellulose, and polyacrylic acid salts; ultraviolet absorbing agents; and aging preventing agents.

Such a third component may be added before, during or after the emulsion polymerization.

The synthetic resin particles for use in the present invention exhibit excellent film forming properties, not only in themselves, but also in the state of an aqueous emulsion. Therefore, in the production of the carrier coated with the resin of the above synthetic resin particles, the carrier can exhibit both excellent durability and productivity.

Such features can be further improved by increasing the Tg of the core layer and decreasing the Tg of the outer shell, so that in the present invention, the resins for the core layer and for the outer shell are appropriately selected, whereby a resin-coated carrier with excellent durability and productivity can be obtained in the present invention.

Furthermore, in the present invention, by setting the weight ratio of the silicone macromonomer (A) in the outer shell of the synthetic resin particles in the range of 50 to 100 to 100 of the entire amount of the silicone macromonomer (A) contained in the entire weight of the polymer or the copolymer of which the core layer and the outer shell are made, so as to localize the presence of the silicone macromonomer (A) on the outer shell, the carrier can further exhibit the above-mentioned features effectively.

The use of the water-soluble synthetic resin solution B will now be explained.

[Synthetic Resin Solution]

The water-soluble resin solution B for the formation of a coating layer for use in the present invention comprises a water-soluble copolymer resin prepared from a silicone macromonomer (A) with a molecular weight of 1,000 to 10,000 and a vinyl monomer (B) which is copolymerizable with the silicone macromonomer (A).

It is preferable that the weight mixing ratio of the above-mentioned silicone macromonomer (A) to the vinyl monomer (B) be in the range of (40:60) to (70:30) in view of the improvement of the close contact performance of the resin coating layer with the core material of the carrier.

It is also particularly preferable that the above-mentioned copolymer resin be allowed to react with a water-soluble melamine resin by mixing the above-mentioned copolymer resin with the water-soluble melamine resin in a parts-by-weight ratio in the range of (100:2) to (100:5) for further improvement of the durability of the resin-coated carrier in the same manner as in the case where the coated layer is prepared from the previously mentioned aqueous dispersion.

[Solution Polymerization]

The water-soluble silicone-modified acrylic resin for use in the present invention can be obtained by subjecting a resin obtained by a conventional solution polymerization to solvent replacement with water.

More specifically, a solvent is placed in a reactor equipped with a stirrer and a dropwise addition device. The solvent is heated in an atmosphere of nitrogen.

A solution composed of the silicone macromonomer (A), the vinyl monomer (B) which is copolymerizable with the silicone macromonomer (B) and a water-soluble initiator is continuously added dropwise to the solvent in the reactor. The reaction mixture is maintained at a predetermined temperature and is then cooled to room temperature. The pH of the reaction mixture is then adjusted with the addition of an aqueous solution of a pH adjusting agent thereto. The reaction mixture is then heated to distil the solvent away therefrom, whereby the water-soluble silicone-modified acrylic resin for use in the present invention can be obtained.

A method of coating a core material with a resin layer by use of the above-mentioned aqueous dispersion and/or water-soluble synthetic resin solution B will now be explained.

A coating layer is formed on the surface of the core material for the carrier by coating the surface of the core material with an aqueous dispersion or a water-soluble resin solution by a conventional coating method such as spray coating method or immersion coating method. Furthermore, it is preferable that the coated layer be heated for promoting the cross linking reaction of the resin in the coated layer after the coating. It is preferable that the heating temperature for the cross linking reaction be 150° C. or more, but as a matter of course, the heating temperature must be below the decomposition temperature of the cross-linked polymer.

To be more specific, the core material for the carrier is placed in a fluidization bed apparatus to fluidize the core material, and the fluidized core material is subjected to spray coating with the above-mentioned aqueous dispersion or water-soluble resin solution serving as a coating liquid. The temperature of the flowing gas for the spray coating is appropriately set in accordance with the spray speed, flow rate of the gas, and the characteristics of the resin to be employed.

The thickness of the coated layer is in the range of 0.05 to 10 μm, preferably in the range of 0.1 to 3.0 μm.

In the case where the water-soluble synthetic resin solution is employed for the formation of the coated layer, a coating layer formation composition comprising the resin solution and an electroconductive material which is dispersed in the resin solution may be preferably coated on the surface of the core material for the carrier for the formation of the coated resin layer.

Such an electroconductive material can be dispersed in the resin solution by adding the electroconductive material in an aqueous solution of the resin, mixing the mixture in a mixer to prepare a coating layer formation composition. The thus prepared coating layer formation composition is coated on the surface of the core material by a conventional method such as spray coating method or immersion coating method.

In this case, if such an electroconductive material is dispersed together with the silicone-modified acrylic synthetic resin particles, each particle comprising the core layer and the outer shell, the electroconductive material is absorbed on the surface of the synthetic resin particles. Therefore, it is necessary that the electroconductive material be first dispersed in the water-soluble resin solution, and thereafter an aqueous dispersion of the synthetic resin particles be added to the first mentioned dispersion with stirring to such an extent that the particles structure is not destroyed.

Such an electroconductive material may be appropriately selected from various conventional electroconductive materials. In view of the low cost, carbon black is preferable. It is preferable that the carbon black for use in the present invention have a BET specific area of 800 $m^2/g$ or more, more preferably 1000 $m^2/g$ or more, and a DBP oil absorption of 200 ml/100 g or more, more preferably 250 ml/100 g or more. This is because when carbon black with a BET specific area of less than 800 $m^2/g$, or with a DBP oil absorption of less than 200 ml/100 g, does not have a sufficient electroconductivity-imparting effect.

As a white electroconductive material for use in a color developer, for example, titanium oxide, zinc oxide and tin oxide can be employed.

In the present invention, the resin coated layer can be prepared not only from either the above-mentioned aqueous dispersion A or the water-soluble synthetic resin solution B, but also from a mixture of the above-mentioned aqueous dispersion A and the water-soluble synthetic resin solution B.

In the latter case, the film formation performance of the resin coated layer is significantly improved.

Furthermore, in the latter case, it is also preferable that a water-soluble melamine resin be contained in the aqueous dispersion A and/or the water-soluble resin solution B; that the glass transition temperature of the core layer of the synthetic resin particles of the aqueous dispersion A be higher by 10° C. or more than the glass transition temperature of the outer shell; and that the weight ratio of the silicone macromonomer (A) in the outer shell of the synthetic resin particles in the aqueous dispersion B be in the range of 50 to 100 to 100 of the entire silicone macromonomer in the synthetic resin particles, in the same manner as in the case where the aqueous dispersion A or the water-soluble resin B is used alone.

In the above case, it is preferable to employ a silicone macromonomer with a molecular weight of 1,000 to 20,000. A representative example of such a silicone macromonomer is polymethylsiloxane.

When a coated layer is prepared from both the aqueous dispersion A and an electroconductive-material-containing water-soluble resin solution B, a carrier for a dry two-component developer, comprising a finely-divided electroconductive material containing silicone-modified acrylic resin coating layer, can be easily and stably produced by a method comprising the steps (1) to (4) of:

(1) preparing a water-soluble silicone-modified acrylic resin solution B comprising a copolymer of a silicone macromonomer (A) with a vinyl group being introduced into one terminal thereof, and a vinyl monomer (B) which is copolymeriz-able with the silicone macromonomer (A);

(2) dispersing finely-divided electroconductive particles in the water-soluble silicone-modified acrylic resin solution B obtained in the step (1);

(3) preparing an aqueous dispersion A of synthetic resin particles, each particle comprising (1) a core layer comprising a polymer of the silicone macromonomer (A) and/or the vinyl monomer (B), and (2) an outer shell which covers the core layer, comprising a polymer of the silicone macromonomer (A) or a copolymer of the silicone macro-monomer (A) and the vinyl monomer (B) which is copolymerizable with the silicone macromonomer (A);

(4) mixing the aqueous dispersion A obtained in the step (3) with the water-soluble silicone-modified acrylic resin solution B which contains the finely-divided electroconductive particles, which is obtained in the step (2) to prepare a coating liquid for the formation of a silicone-modified acrylic resin layer; and coating the surface of the core material with the coating liquid obtained in the step (4).

In the above method, it is preferable to add a step (5) of subjecting the surface of the core material coated with the coating liquid obtained in step (4) to heat treatment at 150° C. or more.

As the core material for the carrier of the present invention, there can be employed conventional magnetic materials, for example, ferromagnetic metals such as iron, cobalt and nickel; alloys and compounds such as magnetite, hematite and ferrite; and particles prepared by dispersing the aforementioned magnetic materials in a binder resin. Of these core materials, resinous core particles prepared by dispersing the aforementioned magnetic materials in a binder resin are most preferable for obtaining high quality images.

Such magnetic-material-dispersed core particles can be prepared, for example, by any of the following methods:

(1) A thermoplastic resin and finely-divided magnetic particles are kneaded and fused to prepare a solid mixture. The thus prepared solid mixture is pulverized and classified to prepare core particles with an appropriate average particle size. The thus prepared core particles may be subjected to hot air treatment to make the core particles spherical.

(2) A thermoplastic resin and finely-divided magnetic particles are kneaded and fused, and a curing agent is added to the mixture, whereby a thermoset solid material is obtained. The thus obtained thermoset solid material is pulverized and classified, whereby core particles are prepared.

(3) A thermoplastic resin and finely-divided magnetic particles are kneaded and fused to prepare a kneaded mixture. The thus obtained kneaded mixture is sprayed into a flow of air at a relatively low temperature to prepare finely-divided particles and solidify the particles by cooling, whereby core particles are prepared.

(4) A thermosetting resin is dissolved in a solvent. In this solution, finely-divided magnetic particles are dispersed and the dispersion is sprayed, whereby fine particles are prepared. The thus prepared fine particles are thermoset and classified, whereby core particles are prepared.

(5) A phenolic compound is allowed to react with an aldehyde compound in an aqueous solvent in the presence of magnetic particles, a suspension stabilizer and a basic catalyst, to prepare a cured material in the form of core particles.

The methods of producing the core material for use in the present invention are not limited to the above methods.

As toner which constitutes a developer for developing latent electrostatic images in combination with the carrier of the present invention, conventional toners can be employed. To be more specific, such a toner can be prepared by fusing and kneading a mixture of a binder resin, a coloring agent and a charge or polarity controlling agent in a heat roll mill, cooling and solidifying the mixture, pulverizing the solidified mixture, and classifying the pulverized mixture.

To such a toner, appropriate additives can be optionally added to the above-mentioned binder resin, coloring agent and charge controlling agent.

As such a binder resin, any of conventional binder resins can be employed. Specific examples of such a binder resin are homopolymers of styrene and substituted styrene such as polystyrene, poly-p-styrene or polyvinyl toluene; styrene copolymers such as styrene-p-chlorostyrene copolymer, styrene-propylene copolymer, styrene-vinyl toluene copolymer, styrene-methyl acrylate copolymer, styrene-methyl methacrylate copolymer, styrene-ethyl methacrylate copolymer, styrene-butyl methacrylate copolymer, styrene-α-methyl chloromethacrylate copolymer, styrene-acrylonitrile copolymer, styrene-vinyl methyl ether copolymer, styrene-vinyl methyl ketone copolymer, styrene-butadiene copolymer, styrene-isoprene copolymer, styrene-maleic acid copolymer, or styrene-maleic acid ester copolymer; polymethyl methacrylate; polybutyl methacrylate; polyvinyl chloride; polyvinyl acetate; polyethylene; polypropylene; polyester; polyurethane; polyamide; epoxy resin; polyvinyl butyral; polyacrylic resin; rosin; modified-rosin; a terpene resin; a phenolic resin; an aliphatic hydrocarbon resin; an aromatic petroleum resin; chlorinated paraffin; or paraffin wax. These binder resins can be used alone or in combination.

As the charge or polarity controlling agent for use in the toner, conventional charge controlling agents can be employs. Specific examples of such a charge controlling agent include metal complexes of monoazo dyes; nitrohumic acid and salts thereof; salicylic acid; naphthoic acid; dicarboxylic acid complexes of metals such as Co, Cr and Fe; amino compounds; tertiary ammonium compounds; and organic dyes.

The amount of a charge or polarity controlling agent to be used in the toner is determined in accordance with the kind of a binder resin to be employed, the presence or absence of an additive, and a method of production of the toner, and there is no general limitation to the amount of a charge or polarity controlling agent to be used.

It is preferable that the amount of a charge or polarity controlling agent be in the range of 0.1 to 20 parts by weight to 100 parts by weight of a binder resin, since when the amount thereof is less than 0.1 parts by weight, the charge quantity of the toner tends to be insufficient for use in practice, while when the amount thereof exceeds 20 parts by weight, the charge quantity of the toner tends to be too large to be used in practice because the fluidity of the developer tends to be lowered and the image density obtained is decreased due to too much electrostatic attraction between the toner and the carrier.

Examples of the coloring agent for use in the toner are black coloring agents such as carbon black, Aniline Black, furnace black and lamp black; cyan coloring agents such as Phthalocyanine Blue, Methylene Blue, Victoria Blue, Methyl Violet, Aniline Blue and Ultramarine Blue; magenta coloring agents such as Rhodamine 6G Lake, dimethyl quinacridone, Watchung red, Rose Bengal, Rhodamine B or Alizarin Lake; and yellow coloring agents such as chrome yellow, Benzidine Yellow, Hansa Yellow, Naphthol Yellow, molybdenum orange, Quinoline Yellow and Tarrazine.

The toner can be used as a magnetic toner by containing therein a magnetic material.

Examples of a magnetic material to be included in the toner include iron oxides such as magnetite, hematite and ferrite; metals such as iron, cobalt and nickel; alloys of the above-mentioned metals and metals such as aluminum, cobalt, copper, lead, magnesium, tin, zinc, antimony, beryllium, bismuth, cadmium, calcium, manganese, selenium, titanium, tungsten and/or vanadium; and mixtures thereof.

It is preferable that such a ferromagnetic material have an average particle size in the range of about 0.1 to 2 μm, and that the amount thereof to be contained in the toner be in the range of about 20 to 200 parts by weight, more preferably in the range of 40 to 150 parts by weight, to 100 parts by weight of a resin component.

Examples of an additive to he contained in the toner include finely-divided inorganic particles of cerium oxide, silicon oxide, titanium oxide, silicon carbide, or colloidal silica. Of these additives, colloidal silica is most preferable.

It is preferable the carrier of the present invention and toner be mixed in such a manner that 30 to 90% of the surface of the carrier particles be deposited with the toner particles.

The features of the present invention will become apparent in the course of the following description of exemplary embodiments, which are given for illustration of the invention and are not intended to be limiting thereof.

I. Examples of Water-Soluble Synthetic Resin Solution B

In the water-soluble synthetic resin solutions B for use in the following Preparation Examples, the silicone macromonomers of the following formula are employed:

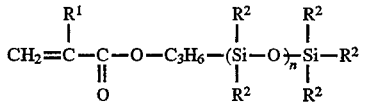

Silicone macromonomer (I-a): $R^1$=$R^2$=methyl group, n=20

Silicone macromonomer (I-b): $R^1$=$R^2$=methyl group, n=about 120

Silicone macromonomer (I-c): $R^1$=$R^2$=methyl group, n=about 150

Silicone macromonomer (I-d): $R^1$=$R^2$=methyl group, n=5

Silicone macromonomer (I-e): $R^1$=H, $R^2$=methyl group, n=20

Silicone macromonomer (I-f): $R^1$=phenyl group, $R^2$=methyl group, n=20

Preparation Example I-1

150 parts by weight of 2-propanol were placed in a 50-ml flask equipped with a stirrer, a thermometer, a condenser, a nitrogen-gas introducing tube, and a dropping funnel, and heated to 80° C. in an atmosphere of nitrogen. Subsequently, a monomer solution prepared by dissolving 0.5 parts by weight of 2,2'-azobisisobutyronitrile in a mixture of 50 parts by weight of silicone macromonomer (I-a), 30 parts by weight of methyl methacrylate and 20 parts by weight of 2-hydroxyethyl methacrylate was continuously added dropwise to the 2-propanol over a period of 2 hours. The thus obtained reaction mixture was allowed to stand for 4 hours for maturing, and then cooled to room temperature.

Thereafter, with the pH of the reaction mixture being adjusted to 7 with the addition of an aqueous solution of triethylamine thereto, the reaction mixture was heated again to remove the 2-propanol therefrom, whereby e water-soluble synthetic resin solution (I-1) was prepared.

Preparation Example I-2

The procedure for preparation of the water-soluble synthetic resin solution (I-1) in Preparation Example I-1 was repeated except that the silicone macromonomer (I-a) employed in Preparation Example I-1 was replaced by a silicone macromonomer (I-b), whereby a water-soluble synthetic resin solution (I-2) was prepared.

Preparation Example I-3

The procedure for preparation of the water-soluble synthetic resin solution (I-1) in Preparation Example I-1 was repeated except that the silicone macromonomer (I-a) employed in Preparation Example I-1 was replaced by a silicone macromonomer (I-c), whereby a water-soluble synthetic resin solution (I-3) was prepared.

Preparation Example I-4

The procedure for preparation of the water-soluble synthetic resin solution (I-1) in Preparation Example I-1 was repeated except that the silicone macromonomer (I-a) employed in Preparation Example I-1 was replaced by a silicone macromonomer (I-d), whereby a water-soluble synthetic resin solution (I-4) was prepared.

Preparation Example I-5

The procedure for preparation of the water-soluble synthetic resin solution (I-1) in Preparation Example I-1 was repeated except that the silicone macromonomer (I-a) employed in Preparation Example I-1 was replaced by a silicone macromonomer (I-e), whereby a water-soluble synthetic resin solution (I-5) was prepared.

Preparation Example I-6

The procedure for preparation of the water-soluble synthetic resin solution (I-1) in Preparation Example I-1 was repeated except that the silicone macromonomer (I-a) employed in Preparation Example I-1 was replaced by a silicone macromonomer (I-f), whereby a water-soluble synthetic resin solution (I-6) was prepared.

Preparation Example I-7

The procedure for preparation of the water-soluble synthetic resin solution (I-1) in Preparation Example I-1 was repeated except that the amount of the silicone macromonomer (I-a) and that of methyl methacrylate employed in Preparation Example I-1 were respectively changed to 40 parts by weight, whereby a water-soluble synthetic resin solution (I-7) was prepared.

Preparation Example I-8

The procedure for preparation of the water-soluble synthetic resin solution (I-1) in Preparation Example I-1 was repeated except that the amount of the silicone macromonomer (I-a) and that of methyl methacrylate employed in Preparation Example I-1 were respectively changed to 20 parts by weight and to 60 parts by weight, whereby a water-soluble synthetic resin solution (I-8) was prepared.

Preparation Example I-9

The procedure for preparation of the water-soluble synthetic resin solution (I-1) in Preparation Example I-1 was repeated except that the amount of the silicone macromonomer (I-a) and that of methyl methacrylate employed in Preparation Example I-1 were respectively changed to 70 parts by weight and to 10 parts by weight, whereby a water-soluble synthetic resin solution (I-9) was prepared.

Preparation Example I-10

The procedure for preparation of the water-soluble synthetic resin solution (I-1) in Preparation Example I-1 was repeated except that the amount of the silicone macromonomer (I-a), that of methyl methacrylate, and that of 2-hydroxyethyl methacrylate employed in Preparation Example I-1 were respectively changed to 80 parts by weight, to 5 parts by weight, and to 15 parts by weight, whereby a water-soluble synthetic resin solution (I-10) was prepared.

Preparation Example I-11

The procedure for preparation of the water-soluble synthetic resin solution (I-2) in Preparation Example I-2 was repeated except that 2 parts by weight of a commercially available water-soluble melamine resin (Trademark "CYMEL 350", made by Mitsui Cytec, Ltd.) were added to the water-soluble resin solution (I-2) prepared in Preparation Example I-2, whereby a water-soluble synthetic resin solution (I-11) was prepared.

Preparation Example I-12

The procedure for preparation of the water-soluble synthetic resin solution (I-11) in Preparation Example I-11 was repeated except that the amount of the commercially available water-soluble melamine resin (Trademark "CYMEL 350", made by Mitsui Cytec, Ltd.) employed in Preparation Example I-11 was changed to 5 parts by weight, whereby a water-soluble synthetic resin solution (I-12) was prepared.

Preparation Example I-13

The procedure for preparation of the water-soluble synthetic resin solution (I-11) in Preparation Example I-11 was repeated except that the amount of the commercially available water-soluble melamine resin (Trademark "CYMEL 350", made by Mitsui Cytec, Ltd.) employed in Preparation Example I-11 was changed to 1 part by weight, whereby a water-soluble synthetic resin solution (I-13) was prepared.

Preparation Example I-14

The procedure for preparation of the water-soluble synthetic resin solution (I-11) in Preparation Example I-11 was repeated except that the amount of the commercially available water-soluble melamine resin (Trademark "CYMEL 350", made by Mitsui Cytec, Ltd.) employed in Preparation Example I-11 was changed to 7 parts by weight, whereby a water-soluble synthetic resin solution (I-14) was prepared.

EXAMPLE I-1

100 g of pure water was added to 100 of the synthetic resin solution (I-1) prepared in Preparation Example I-1, whereby a resin coating layer formation liquid for carrier particles was prepared.

The above prepared resin coating layer formation liquid and 1 kg of core particles (Trademark "F-150", made by Powder Tech Co., Ltd., with a particle diameter of 80 μm) were placed in a fluidized bed coating apparatus, and the surface of the core particles was coated with the resin coating layer formation liquid by the fluidized bed coating method.

The thus prepared resin coated particles were dried for about 5 minutes, and passed through a screen with a mesh of 150 μm, whereby a carrier No. I-1 according to the present invention was obtained.

EXAMPLE I-2

The procedure for preparation of the carrier No. I-1 in Example I-1 was repeated except that the synthetic resin solution (I-1) in the resin coating layer formation liquid employed in Example I-1 was replaced by the synthetic resin solution (I-2) prepared in Preparation Example I-2, whereby a carrier No. I-2 according to the present invention was obtained.

EXAMPLE I-3

The procedure for preparation of the carrier No. I-1 in Example I-1 was repeated except that the synthetic resin solution (I-1) in the resin coating layer formation liquid employed in Example I-1 was replaced by the synthetic resin solution (I-5) prepared in Preparation Example I-5, whereby a carrier No. I-3 according to the present invention was obtained.

EXAMPLE I-4

The procedure for preparation of the carrier No. I-1 in Example I-1 was repeated except that the synthetic resin solution (I-1) in the resin coating layer formation liquid employed in Example I-1 was replaced by the synthetic resin solution (I-6) prepared in Preparation Example I-6, whereby a carrier No. I-4 according to the present invention was obtained.

EXAMPLE I-5

The procedure for preparation of the carrier No. I-1 in Example I-1 was repeated except that the synthetic resin solution (I-1) in the resin coating layer formation liquid employed in Example I-1 was replaced by the synthetic resin solution (I-7) prepared in Preparation Example I-7, whereby a carrier No. I-5 according to the present invention was obtained.

EXAMPLE I-6

The procedure for preparation of the carrier No. I-1 in Example I-1 was repeated except that the synthetic resin solution (I-1) in the resin coating layer formation liquid employed in Example I-1 was replaced by the synthetic resin solution (I-8) prepared in Preparation Example I-8, whereby a carrier No. I-6 according to the present invention was obtained.

EXAMPLE I-7

The procedure for preparation of the carrier No. I-1 in Example I-1 was repeated except that the synthetic resin solution (I-1) in the resin coating layer formation liquid employed in Example I-1 was replaced by the synthetic resin solution (I-9) prepared in Preparation Example I-9, whereby a carrier No. I-7 according to the present invention was obtained.

EXAMPLE I-8

The procedure for preparation of the carrier No. I-1 in Example I-1 was repeated except that the synthetic resin solution (I-1) in the resin coating layer formation liquid employed in Example I-1 was replaced by the synthetic resin solution (I-10) prepared in Preparation Example I-10, whereby a carrier No. I-8 according to the present invention was obtained.

EXAMPLE I-9

The procedure for preparation of the carrier No. I-1 in Example I-1 was repeated except that the synthetic resin solution (I-1) in the resin coating layer formation liquid employed in Example I-1 was replaced by the synthetic resin solution (I-11) prepared in Preparation Example 1-11, whereby a carrier No. I-9 according to the present invention was obtained.

EXAMPLE I-10

The procedure for preparation of the carrier No. I-1 in Example I-1 was repeated except that the synthetic resin solution (I-1) in the resin coating layer formation liquid employed in Example I-1 was replaced by the synthetic resin solution (I-12) prepared in Preparation Example I-12, whereby a carrier No. I-10 according to the present invention was obtained.

EXAMPLE I-11

The procedure for preparation of the carrier No. I-1 in Example I-1 was repeated except that the synthetic resin solution (I-1) in the resin coating layer formation liquid employed in Example I-1 was replaced by the synthetic resin solution (I-13) prepared in Preparation Example I-13, whereby a carrier No. I-11 according to the present invention was obtained.

EXAMPLE I-12

The procedure for preparation of the carrier No. I-1 in Example I-1 was repeated except that the synthetic resin solution (I-1) in the resin coating layer formation liquid employed in Example I-1 was replaced by the synthetic resin solution (I-14) prepared in Preparation Example I-14, whereby a carrier No. I-12 according to the present invention was obtained.

EXAMPLE I-13

The procedure for preparation of the carrier No. I-2 in Example I-2 was repeated except that the resin coated carrier particles obtained in Example I-2 were further subjected to heat treatment at 160° C. for 30 minutes after the drying process conducted in Example I-2, whereby a carrier No. I-13 according to the present invention was obtained.

EXAMPLE I-14

The procedure for preparation of the carrier No. I-2 in Example I-2 was repeated except that the resin coated carrier particles obtained in Example I-2 were further subjected to heat treatment of 130° C. for 30 minutes after the drying process conducted in Example I-2, whereby a carrier No. I-14 according to the present invention was obtained.

EXAMPLE I-15

The procedure for preparation of the carrier No. I-1 in Example I-1 was repeated except that the synthetic resin solution (I-1) in the resin coating layer formation liquid employed in Example I-1 was replaced by the synthetic resin solution (I-3) prepared in Preparation Example I-3, whereby a carrier No. I-15 according to the present invention was obtained.

Comparative Example I-1

The procedure for preparation of the carrier No. I-1 in Example I-1 was repeated except that the synthetic resin solution (I-1) in the resin coating layer formation liquid employed in Example I-1 was replaced by the synthetic resin solution (I-4) prepared in Preparation Example I-4, whereby a comparative carrier No. I-1 was obtained.

[Preparation of Toner]

A mixture of the following components was fused and kneaded in a roll mill of 140° C.:

| | Parts by Weight |
|---|---|
| Styrene-acrylic resin (Trademark "Himer 75" made by Sanyo Chemical Industries, Ltd.) | 88 |
| Carbon black (Trademark "#44" made by Mitsubishi Chemical Industries, Ltd.) | 10 |
| Metal-containing azo dye (Trademark "Bontron S-34" made by Orient Chemical Industries, Ltd.) | 2 |

The thus obtained mixture was cooled, pulverized in a jet mill and classified, whereby a toner A with an average particle diameter of 10 μm was prepared.

[Preparation of Dry Two-component Developer]

By use of each of the carriers No. I-1 to No. I-15 according to the present invention and the comparative carrier No. I-1, dry two-component developers were prepared in such a manner that 97 parts by weight of each carrier and 3 parts by weight of the above prepared toner A were mixed in a ball mill.

Each of the thus obtained two-component developers was subjected to an image formation test in such a manner that the developer was incorporated in a commercially available copying machine (Trademark "FT-6960L", made by Ricoh Company, Ltd.), and 100,000 copies were made.

Then, the following evaluations were carried out:

(1) Charge quantity

The charge quantities of the toner were measured by the blow-off method at the time of making a first copy and after making 100,000 copies.

(2) Spent phenomenon

The toner A was removed from each two-component developer by the blow-off method after making 100,000 copies, and the weight ($W_1$) of the remaining carrier was measured. The above carrier was put in toluene to dissolve the fused toner attached to the carrier therein. After the carrier was washed and dried, the weight ($W_2$) of the carrier was measured. The degree of the spent toner (S) was expressed by the percentage calculated in accordance with the following formula:

$$\text{Degree of Spent toner } (S)=[(W_1-W_2)/W_1]\times 100$$

The degree of the spent toner (S) was assessed in accordance with the following scale:

⊙: $0 \leqq (S) \leqq 0.01$ wt. %

○: 0.01 wt. % $< (S) \leqq 0.02$ wt. %

Δ: 0.02 wt. %<(S)≦0.05 wt. % x: (S)>0.05 wt. %

(3) Uniformity of coating layer of carrier particles

The surface of the carrier particles was observed by use of a scanning-type electron microscope (SEM), and the uniformity of the coating layer of carrier particles was assessed in accordance with the following scale:

⊙: Excellent

○: Good

Δ: Slightly poor x: Very poor (4) Aggregation of carrier particles

In the course of manufacturing the carrier particles, the weight ($W_1$) of the carrier particles was measured before screening. The carrier particles were passed through a screen with a mesh of 150 μm (specified in the Japanese Industrial Standard JIS Z 8801), and the weight ($W_2$) of the carrier particles remaining on the screen was measured. The aggregation ratio of the carrier particles was calculated in accordance with the following formula:

$$\text{Aggregation ratio of carrier (\%)}=(W_1-W_2)\times 100$$

(5) Peeling of coating layer of carrier particles

The toner A was removed from each two-component developer by the blow-off method after making copies. By observing the surface of carrier particles using the SEM, it was examined whether the coating layer was peeled from the carrier core particles or not. The peeling degree was assessed in accordance with the following scale:

⊙: There was no peeling of coating layer.

○: The coating layer was peeled from a few core particles.

Δ: The coating layer was considerably peeled from the core particles.

x: The coating layer was peeled from most core particles.

(6) $T_{Si}/T_C$ Ratio

The results of the above-mentioned evaluations are shown in Table 1.

TABLE 1

| | Charge Quantity (μC/g) | | | Uniformity of Coating | Aggregation | | |
|---|---|---|---|---|---|---|---|
| | At initial stage | After making 100,000 copies | Spent Toner | Layer of Carrier Particles | Ratio of Carrier Particles | Peeling of Coating Layer | $T_{Si}/T_C$ |
| Ex. I-1 | −30.3 | −26.3 | ○ | ⊙ | 2.5 | ○ | 1.7 |
| Ex. I-2 | −31.5 | −27.8 | ○ | ○ | 2.8 | ○ | 2.2 |
| Ex. I-3 | −26.8 | −23.0 | ○ | ⊙ | 2.4 | ○ | 1.7 |
| Ex. I-4 | −33.5 | −28.8 | ○ | ⊙ | 2.6 | ○ | 1.7 |
| Ex. I-5 | −29.5 | −24.9 | ○ | ⊙ | 2.2 | ○ | 1.3 |
| Ex. I-6 | −28.5 | −22.3 | Δ | ⊙ | 1.3 | ⊙ | 1.0 |
| Ex. I-7 | −30.1 | −25.1 | ○ | ○ | 3.9 | Δ | 2.1 |
| Ex. I-8 | −29.5 | −21.8 | ○ | Δ | 4.9 | Δ | 2.2 |
| Ex. I-9 | −32.5 | −28.8 | ○ | ○ | 2.7 | ⊙ | 1.3 |
| Ex. I-10 | −31.2 | −28.5 | ○ | ○ | 2.9 | ⊙ | 1.3 |
| Ex. I-11 | −32.0 | −28.1 | ○ | ○ | 2.9 | ○ | 1.3 |
| Ex. I-12 | −32.8 | −26.1 | ○ | Δ | 3.1 | ○ | 1.3 |
| Ex. I-13 | −28.8 | −27.5 | ⊙ | ⊙ | 2.8 | ○ | 2.2 |
| Ex. I-14 | −29.5 | −26.3 | ○ | ○ | 2.8 | ○ | 2.2 |
| Ex. I-15 | −29.8 | −26.8 | ○ | x | 8.5 | Δ | 2.8 |
| Comp. Ex. I-1 | −30.9 | −16.7 | x | ⊙ | 0.5 | ⊙ | 0.8 |

As can be seen from the results shown in Table 1, the carriers according to the present invention can be easily produced with a high yield, and the two-component developers comprising the carriers of the present invention show sufficiently stable charge quantity and excellent durability.

II. Examples of Aqueous Dispersion A

The monomers, water-soluble initiators and surfactants employed in the preparation of the aqueous dispersions are represented as follows:

Methyl methacrylate: MMA n-butyl acrylate: n-BA 2-hydroxyethyl methacrylate: 2-HEMA Sodium dodecylbenzenesulfonate: DBS The silicone macromonomers employed in the preparation of the aqueous dispersions are as follows:

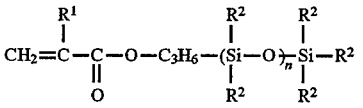

Silicone macromonomer (II-a): $R^1=R^2$=methyl group, n=5

Silicone macromonomer (II-b): $R^1=R^2$=methyl group, n=10

Silicone macromonomer (II-c): $R^1=R^2$=methyl group, n=20

Silicone macromonomer (II-d): $R^1=R^2$=methyl group, n=60

Silicone macromonomer (II-e): $R^1=R^2$=methyl group, n=about 120

Silicone macromonomer (II-f): $R^1=R^2$=methyl group, n=about 250

Silicone macromonomer (II-g): $R^1=R^2$=methyl group, n=about 320

Silicone macromonomer (II-h): $R^1$=phenyl group, $R^2$=methyl group, n=60

<Preparation Examples of Aqueous Dispersions of Synthetic Resin Particles>

Preparation Example II-1

100 parts by weight of pure water and 0.5 parts by weight of DBS were placed in a reactor equipped with a stirrer and a dropping funnel, and the mixture was heated to 70° C. in an atmosphere of nitrogen. To the above mixture, one part by weight of succinic acid peroxide were added.

A mixture of 20 parts by weight of MMA and 5 parts by weight of a silicone macromonomer (II-d) was emulsified with the addition thereto of 0.3 parts by weight of DBS and 5 parts by weight of pure water, whereby a preliminary emulsion (a) serving as a core layer formation material was obtained. The thus obtained preliminary emulsion (a) was continuously added dropwise to the mixture in the reactor over a period of 1 hour, and the temperature of the reaction mixture was maintained for 2 hours, so that resinous core particles were formed.

75 parts by weight of a silicone macromonomer (II-d) were emulsified with the addition thereto of 3.5 parts by weight of DBS and 50 parts by weight of pure water, whereby a preliminary emulsion (b) serving as an outer shell forming material was prepared.

The thus obtained preliminary emulsion (b) was continuously added dropwise to the resinous cure particles in the reactor over a period of 3 hours, and the temperature of the reaction mixture was maintained for 2 hours.

Thereafter, the mixture was cooled to room temperature, and the pH of the mixture was adjusted to 7 with the addition of ammonia water to the mixture. With the addition of 4 parts by weight of a commercially available water-soluble melamine resin (Trademark "CYMEL 350", made by Mitsui Cytec, Ltd.) to the above mixture, an aqueous dispersion of synthetic resin particles No. 1 was obtained.

Preparation Example II-2

The procedure for preparation of the aqueous dispersion of synthetic resin particles No. 1 in Preparation Example II-1 was repeated except that the 4 parts by weight of the commercially available water-soluble melamine resin (Trademark "CYMEL 350", made by Mitsui Cytec, Ltd.) added in Preparation Example II-1 were not added to the mixture after the pH adjustment, whereby an aqueous dispersion of synthetic resin particles No. 2 was obtained.

Preparation Example II-3

The procedure for preparation of the aqueous dispersion of synthetic resin particles No. 1 in Preparation Example II-1 was repeated except that the silicone macromonomer (II-d) for use in the preparation of the outer shell formation material in Preparation Example II-1 was replaced by a silicone macromonomer (II-h), whereby an aqueous dispersion of synthetic resin particles No. 3 was obtained.

Preparation Example II-4

The procedure for preparation of the aqueous dispersion of synthetic resin particles No. 1 in Preparation Example II-1 was repeated except silicone macromonomer (II-d) for use in the preparation of the outer shell formation material in Preparation Example II-1 was replaced by a silicone macromonomer (II-a), whereby an aqueous dispersion of synthetic resin particles No. 4 was obtained.

Preparation Example II-5

The procedure for preparation of the aqueous dispersion of synthetic resin particles No. 1 in Preparation Example II-1 was repeated except that the silicone macromonomer (II-d) for use in the preparation of the outer shell formation material in Preparation Example II-1 was replaced by a silicone macromonomer (II-b), whereby an aqueous dispersion of synthetic resin particles No. 5 was obtained.

Preparation Example II-6

The procedure for preparation of the aqueous dispersion of synthetic resin particles No. 1 in Preparation Example II-1 was repeated except that the silicone macromonomer (II-d) for use in the preparation of the outer shell formation material in Preparation Example II-1 was replaced by a silicone macromonomer (II-f), whereby an aqueous dispersion of synthetic resin particles No. 6 was obtained.

Preparation Example II-7

The procedure for preparation of the aqueous dispersion of synthetic resin particles No. 1 in Preparation Example II-1 was repeated except that the silicone macromonomer (II-d) for use in the preparation of the outer shell formation material in Preparation Example II-1 was replaced by a silicone macromonomer (II-g), whereby an aqueous dispersion of synthetic resin particles No. 7 was obtained.

Preparation Example II-8

100 parts by weight of pure water and 0.5 parts by weight of DBS were placed in a reactor equipped with a stirrer and a dropping funnel, and the mixture was heated to 70° C. in an atmosphere of nitrogen.

To the above prepared mixture, 1.0 part by weight of succinic acid peroxide were added.

A mixture of 22.5 parts by weight of MMA, 7.5 parts by weight of n-BA, and 20 parts by weight of a silicone macromonomer (II-d) was emulsified with the addition thereto of 1.75 parts by weight of DBS and 25 parts by weight of pure water, whereby a preliminary emulsion (a) serving as a core layer formation material.

The thus obtained preliminary emulsion (a) was continuously added dropwise to the mixture in the reactor over a period of 2 hours, and the temperature of the reaction mixture was maintained for 2 hours, so that resinous core particles were formed.

A mixture of 22.5 parts by weight of MMA, 7.5 parts by weight of n-BA and 20 parts by weight of a silicone macromonomer (II-d) was emulsified with the addition thereto of 1.75 parts by weight of DBS and 25 parts by weight of pure water, whereby a preliminary emulsion (b) serving as an outer shell formation material was obtained. The thus obtained preliminary emulsion (b) was continuously added dropwise to the resinous core particles in the reactor over a period of 2 hours, and the temperature of the reaction mixture was maintained for 2 hours.

The mixture was then cooled to room temperature, and the pH of the mixture was adjusted to 7 with the addition of ammonia water to the mixture. With the addition of 4 parts by weight of a commercially available water-soluble melamine resin (Trademark "CYMEL 350", made by Mitsui Cytec, Ltd.) to the above prepared mixture, an aqueous dispersion of synthetic resin particles No. 8 was obtained.

Preparation Example II-9

100 parts by weight of pure water and 0.5 parts by weight of DBS were placed in a reactor equipped with a stirrer and a dropping funnel, and the mixture was heated to 70° C. in an atmosphere of nitrogen. To the above prepared mixture, one part by weight of succinic acid peroxide was added.

A mixture of 25 parts by weight of MMA, 7.5 parts by weight of n-BA, and 17.5 parts by weight of a silicone macromonomer (II-d) was emulsified with the addition thereto of 1.75 parts by weight of DBS and 25 parts by weight of pure water, whereby a preliminary emulsion (a) serving as an outer shell formation material. The thus obtained preliminary emulsion (a) was continuously added dropwise to the mixture in the reactor over a period of 2 hours, and the temperature of the reaction mixture was maintained for 2 hours, whereby resinous core particles were formed.

A mixture of 22.5 parts by weight of MMA, 7.5 parts by weight of n-BA and 20 parts by weight of a silicone macromonomer (II-d) was emulsified with the addition thereto of 1.75 parts by weight of DBS and 25 parts by weight of pure water, whereby a preliminary emulsion (b) serving as an outer shell formation material was obtained. The thus obtained preliminary emulsion (b) was continuously added dropwise to the resinous core particles in the reactor over a period of 2 hours, and the temperature of the reaction mixture was maintained for 2 hours. The mixture was then cooled to room temperature, and the pH of the mixture was adjusted to 7 with the addition of ammonia water to the mixture. With the addition of 4 parts by weight of a commercially available water-soluble melamine resin (Trademark "CYMEL 350", made by Mitsui Cytec, Ltd.) to the above prepared mixture, an aqueous dispersion of synthetic resin particles No. 9 was obtained.

Preparation Example II-10

100 parts by weight of pure water and 0.5 parts by weight of DBS were placed in a reactor equipped with a stirrer and a dropping funnel, and the mixture was heated to 70° C. in an atmosphere of nitrogen. To the above prepared mixture, one part by weight of succinic acid peroxide was added.

A mixture of 30 parts by weight of MMA, 7.5 parts by weight of n-BA, and 15 parts by weight of a silicone macromonomer (II-d) was emulsified with the addition thereto of 1.75 parts by weight of DBS and 25 parts by weight of pure water, whereby a preliminary emulsion (a) serving as a core layer formation material was obtained. The thus obtained preliminary emulsion (a) was continuously added dropwise to the mixture in the reactor over a period of 2 hours, and the temperature of the reaction mixture was maintained for 2 hours, whereby resinous core particles were formed.

A mixture of 22.5 parts by weight of MMA, 5 parts by weight of n-BA and 20 parts by weight of a silicone macromonomer (II-d) was emulsified with the addition thereto of 1.75 parts by weight of DBS and 25 parts by weight of pure water, whereby a preliminary emulsion (b) serving as an outer shell formation material was obtained. The thus obtained preliminary emulsion (b) was continuously added dropwise to the resinous core particles in the reactor over a period of 2 hours, and the temperature of the reaction mixture was maintained for 2 hours. The mixture was then cooled to room temperature, and the pH of the mixture was adjusted to 7 with the addition of ammonia water to the mixture. With the addition of 4 parts by weight of a commercially available water-soluble melamine resin (Trademark "CYMEL 350", made by Mitsui Cytec, Ltd.) to the above prepared mixture, an aqueous dispersion of synthetic resin particles No. 10 was obtained.

Preparation Example I-11

100 parts by weight of pure water and 0.5 parts by weight of DBS were placed in a reactor equipped with a stirrer and a dropping funnel, and the mixture was heated to 70° C. in an atmosphere of nitrogen. To the above mixture, one part by weight of succinic acid peroxide was added.

A mixture of 55 parts by weight of MMA and 20 parts by weight of a silicone macromonomer (II-d) was emulsified with the addition thereto of 2.4 parts by weight of DBS and 35 parts by weight of pure water, whereby a preliminary emulsion (a) serving as a core layer formation material was obtained. The thus obtained preliminary emulsion (a) was continuously added dropwise to the mixture in the reactor over a period of 2.5 hours, and the temperature of the reaction system was maintained for 2 hours, so that resinous core particles were formed.

A mixture of 5 parts by weight of MMA, 10 parts by weight of n-BA and 10 parts by weight of a silicone macromonomer (II-c) was emulsified with the addition thereto of 1.05 parts by weight of DBS and 15 parts by weight of pure water, whereby a preliminary emulsion (b) serving as an outer shell formation material was obtained. The thus obtained preliminary emulsion (b) was continuously added dropwise to the resinous core particles in the reactor over a period of 1.5 hours, and the temperature of the reaction mixture was maintained for 2 hours. The mixture was then cooled to room temperature, and the pH of the mixture was adjusted to 7 with the addition of ammonia water to the mixture. With the addition of 4 parts by weight of a commercially available water-soluble melamine resin (Trademark "CYMEL 350", made by Mitsui Cytec, Ltd.) to the above prepared mixture, an aqueous dispersion of synthetic resin particles No. 11 was obtained.

Preparation Example II-12

100 parts by weight of pure water and 0.5 parts by weight of DBS were placed in a reactor equipped with a stirrer and a dropping funnel, and the mixture was heated to 70° C. in an atmosphere of nitrogen. To the above mixture, one part by weight of succinic acid peroxide was added.

A mixture of 50 parts by weight of MMA and 20 parts by weight of a silicone macromonomer (II-d) was emulsified with the addition thereto of 2.45 parts by weight of DBS and 35 parts by weight of pure water, whereby a preliminary emulsion (a) serving as a core layer formation material was obtained. The thus obtained preliminary emulsion (a) was continuously added dropwise to the mixture in the reactor over a period of 2.5 hours, and the temperature of the reaction mixture was maintained for 2 hours, whereby resinous core particles were formed.

A mixture of 10 parts by weight of n-BA, 5 parts by weight of 2-HEMA and 15 parts by weight of a silicone macromonomer (II-c) was emulsified with the addition thereto of 1.05 parts by weight of DBS and 15 parts by weight of pure water, whereby a preliminary emulsion (b) serving as an outer shell formation material was obtained. The thus obtained preliminary emulsion (b) was continuously added dropwise to the resinous core particles in the reactor over a period of 1.5 hours, and the temperature of the reaction system was maintained for 2 hours. The mixture was then cooled to room temperature, and the pH of the mixture was adjusted to 7 with the addition of ammonia water to the mixture. With the addition of 4 parts by weight of a commercially available water-soluble melamine resin (Trademark "CYMEL 350", made by Mitsui Cytec, Ltd.) to the above prepared mixture, an aqueous dispersion of synthetic resin particles No. 12 was obtained.

Preparation Example II-13

100 parts by weight of pure water and 0.5 parts by weight of DBS were placed in a reactor equipped with a stirrer and a dropping funnel, and the mixture was heated to 70° C. in an atmosphere of nitrogen. To the above prepared mixture, one part by weight of succinic acid peroxide was added.

A mixture of 40 parts by weight of MMA, 5 parts by weight of n-BA and 5 parts by weight of 2-HEMA was emulsified with the addition thereto of 1.75 parts by weight of DBS and 25 parts by weight of pure water, whereby a preliminary emulsion (a) serving as an outer shell formation material was obtained. The thus obtained preliminary emulsion (a) was continuously added dropwise to the mixture in the reactor over a period of 2 hours, and the temperature of the reaction mixture was maintained for 2 hours, whereby resinous core particles were formed.

A mixture of 15 parts by weight of n-BA, 5 parts by weight of 2-HEMA, and 30 parts by weight of a silicone macromonomer (II-c) was emulsified with the addition thereto of 1.75 parts by weight of DBS and 25 parts by weight of pure water, whereby a preliminary emulsion (b) serving as an outer shell formation material was obtained. The thus obtained preliminary emulsion (b) was continuously added dropwise to the resinous core particles in the reactor over a period of 2 hours, and the temperature of the reaction mixture was maintained for 2 hours. The mixture was then cooled to room temperature, and the pH of the mixture was adjusted to 7 with the addition of ammonia water to the mixture. With the addition of 4 parts by weight of a commercially available water-soluble melamine resin (Trademark "CYMEL 350", made by Mitsui Cytec, Ltd.) to the above prepared mixture, an aqueous dispersion of synthetic resin particles No. 13 was obtained.

Table 2 shows the formulations for the core layer and the outer shell of each of the aqueous dispersions of synthetic resin particles No. 1 to No. 13 prepared in Preparation Examples II-1 to II-13.

EXAMPLES II-2 TO II-13

The procedure for preparation of the carrier No. II-1 in Example II-1 was repeated except that the aqueous dispersion of synthetic resin particles No. 1 for use in the resin coating layer formation liquid for carrier particles in Example II-1 was replaced by the aqueous dispersions of synthetic resin particles No. 2 to No. 13, respectively, in Examples II-2 to II-13.

Thus, carriers No. II-2 to No. II-13 according to the present invention were obtained.

[Preparation of Toner]

A mixture of the following components was fused and kneaded in a roll mill of 120° C.:

| | Parts by Weight |
|---|---|
| Polyester resin (Mw = 55000, Tg = 62° C.) | 93 |
| Carbon black (Trademark "#44" made by Mitsubishi Chemical Industries, Ltd.) | 5 |
| Metal-containing azo dye (Trademark "Spilon Black T-95" made by Hodogaya Chemical Co., Ltd.) | 2 |

The thus obtained mixture was cooled, pulverized in a jet mill, and classified, whereby a toner B with an average particle diameter of 10 μm was prepared.

[Preparation of Two-component Developer]

TABLE 2

| Preparation Example No. | II-1 | II-2 | II-3 | II-4 | II-5 | II-6 | II-7 | II-8 | II-9 | II-10 | II-11 | II-12 | II-13 |
|---|---|---|---|---|---|---|---|---|---|---|---|---|---|
| Core Layer | | | | | | | | | | | | | |
| Tg (°C.) | 45 | 45 | 48 | 26 | 35 | 62 | 69 | 38 | 42 | 46 | 71 | 67 | 61 |
| MMA | 20 | 20 | 20 | 20 | 20 | 20 | 20 | 22.5 | 25 | 30 | 55 | 50 | 40 |
| n-BA | | | | | | | | 7.5 | 7.5 | 7.5 | | | 5 |
| 2-HEMA | | | | | | | | | | | | | 5 |
| Silicone macromonomer | d | d | k | a | b | f | g | d | d | d | d | d | |
| Parts by weight | 5 | 5 | 5 | 5 | 5 | 5 | 5 | 20 | 17.5 | 15 | 20 | 20 | |
| Outer Shell | | | | | | | | | | | | | |
| Tg (°C.) | −13 | −13 | −11 | −17 | −15 | −1 | 6 | 38 | 38 | 40 | −7 | −15 | −11 |
| MMA | | | | | | | | 22.5 | 22.5 | 22.5 | 5 | | |
| n-BA | | | | | | | | 7.5 | 7.5 | 5 | 10 | 10 | 15 |
| 2-HEMA | | | | | | | | | | | | 5 | 5 |
| Silicone macromonomer | d | d | k | a | b | f | g | d | d | d | c | c | c |
| Parts by weight | 75 | 75 | 75 | 75 | 75 | 75 | 75 | 20 | 20 | 20 | 10 | 15 | 30 |
| Weight ratio of silicone macromonomers | 93.75 | 73.75 | 93.75 | 93.76 | 93.75 | 93.75 | 73.75 | 50 | 53.33 | 57.14 | 33.33 | 42.86 | 100 |

EXAMPLE II-1

50 parts by weight of pure water and 50 parts by weight of the aqueous dispersion of synthetic resin particles No. 1 obtained in Preparation Example II-1 were mixed with an agitating blade, so that a resin coating layer formation liquid for carrier particles was obtained.

The above prepared resin coating layer formation liquid and 1,000 parts by weight of ferrite particles were placed in a fluidized bed coating apparatus, and the surface of the ferrite core particles was coated with the resin coating layer formation liquid by the fluidized bed coating method.

The thus resin coated particles were dried at room temperature for 10 minutes, whereby a carrier No. II-1 according to the present invention was obtained.

By use of each of the carriers Nos. II-1 to II-13 according to the present invention, two-component developers were prepared in such a manner that 95 parts by weight of each carrier and 5 parts by weight of the above prepared toner B were mixed in a ball mill.

Each of the thus obtained two-component developers was subjected to an image formation test in such a manner that the developer was incorporated in a commercially available copying machine (Trademark "FT-6960L", made by Ricoh Company, Ltd.), and 300,000 copies were made.

Then, the following evaluations were carried out:

(1) Charge quantity

The charge quantities of the toner were measured by the blow-off method at the initial stage, after making 100,000 copies and after making 300,000 copies.

(2) Spent phenomenon

The degree of the spent toner (S) was obtained after making 100,000 copies and 300,000 copies by the same method, and assessed in accordance with the same scale as previously explained.

(3) uniformity of coating layer of carrier particles

The surface of the carrier particles was observed by use of a scanning-type electron microscope (SEM), and the uniformity of the coating layer of carrier particles was assessed in accordance with the following scale:

◎: Excellent

○: Good

Δ: Slightly poor x: Very poor

The results of the above-mentioned evaluation are shown in Table 3.

TABLE 3

| | Charge Quantity (μC/g) | | | Spent Toner | | Uniformity |
|---|---|---|---|---|---|---|
| | At initial stage | After making 100,000 copies | After making 300,000 copies | After making 100,000 copies | After making 300,000 copies | of Coating Layer of Carrier Particles |
| Ex. II-1 | −34 | −31 | −28 | ◎ | ◎ | ○ |
| Ex. II-2 | −33 | −31 | −27 | ◎ | ◎ | ◎ |
| Ex. II-3 | −31 | −25 | −23 | ○ | Δ | ◎ |
| Ex. II-4 | −30 | −25 | −20 | ○ | Δ | ◎ |
| Ex. II-5 | −30 | −28 | −23 | ◎ | ○ | ◎ |
| Ex. II-6 | −36 | −34 | −32 | ◎ | ◎ | ○ |
| Ex. II-7 | −33 | −31 | −29 | ◎ | ◎ | Δ |
| Ex. II-8 | −32 | −29 | −25 | ◎ | ○ | Δ |
| Ex. II-9 | −34 | −32 | −29 | ◎ | ○ | ○ |
| Ex. II-10 | −33 | −30 | −28 | ◎ | ○ | ○ |
| Ex. II-11 | −27 | −24 | −20 | ○ | Δ | ◎ |
| Ex. II-12 | −30 | −29 | −26 | ◎ | ○ | ◎ |
| Ex. II-13 | −36 | −34 | −33 | ◎ | ◎ | ◎ |

As can be seen from the results shown in Table 3, the two-component developers comprising the carriers of the present invention show sufficiently stable charge quantity and excellent durability. In addition, the spent toner phenomenon can be effectively prevented.

III. Examples of Combined Use of Aqueous Dispersion A/Electroconductive-Material-Containing Water-Soluble Resin Solution

EXAMPLE II-1

50 parts by weight of the water-soluble synthetic resin solution (I-1) prepared in Preparation Example I-1, 100 parts by weight of pure water and 5 parts by weight of carbon black were mixed in a homomixer to prepare a mixture. Thereafter, 50 parts by weight of the aqueous dispersion of synthetic resin particles No. 1 prepared in Preparation Example II-1 were added to the above prepared mixture and mixed by an agitating blade, whereby a resin coating layer formation liquid for carrier particles was prepared.

The above prepared resin coating layer formation liquid and 1,000 parts by weight of ferrite particles were placed in a fluidized bed coating apparatus, and the surface of the ferrite core particles was coated with the resin coating layer formation liquid by the fluidized bed coating method.

The thus prepared resin coated particles were dried at room temperature for 10 minutes, whereby a carrier No. III-1 according to the present invention was obtained.

EXAMPLES III-2 TO III-13

The procedure for preparation of the carrier No. III-1 in Example III-1 was repeated except that the aqueous dispersion of synthetic resin particles No. 1 for use in the coating layer formation liquid for carrier particles in Example III-1 was replaced by the aqueous dispersions of synthetic resin particles No. 2 to No. 13, respectively in Examples III-2 to III-13, whereby carriers No. III-2 to No. III-13 according to the present invention were obtained.

Comparative Example III-1

50 parts by weight of the aqueous dispersion of synthetic resin particles No. 1 prepared in Preparation Example II-1, 100 parts by weight of pure water and 5 parts by weight of carbon black were mixed in a homomixer to prepare a resin coating layer formation liquid for carrier particles.

However, the carbon black adsorbed the synthetic resin particles, so that it was impossible to coat the ferrite particles with the coating layer formation liquid by the fluidized bed coating method.

[Preparation of Two-component Developer]

Using each of the carriers Nos. III-1 to III-13 according to the present invention, a two-component developer was fabricated in such a manner that 95 parts by weight of each carrier and 5 parts by weight of the previously obtained toner B were mixed in a ball mill.

Each of the thus obtained two-component developers was subjected to an image formation test in such a manner that the developer was incorporated in a commercially available copying machine (Trademark "FT-6960L", made by Ricoh Company, Ltd.), and 300,000 copies were made.

Then, the following evaluations were carried out:

(1) Charge quantity

The charge quantities of the toner were measured by the blow-off method at the time of making a first copy, and after making 100,000 copies and 300,000 copies.

(2) Spent phenomenon

The degree of the spent toner (S) was obtained after making 100,000 copies and 300,000 copies by the same method and assessed in accordance with the same scale as previously explained.

(3) Uniformity of image density

By using a Mcbeth reflection-type densitometer, the image density of the images obtained at the initial stage was measured at the upper, middle and lower portions in the images, with three positions selected at random in each portion. The difference between the maximum value of the image density and the minimum value thereof was obtained.

The uniformity of the image density was expressed by the difference (D) between the maximum image density and the minimum image density, and assessed in accordance with the following scale:

◎: $0.00 \leqq (D) \leqq 0.05$

○: $0.06 \leqq (D) \leqq 0.10$

Δ: $0.11 \leqq (D) \leqq 0.15$ x: $(D) > 0.15$ (4) Surface condition of coated film of carrier The surface of the carrier particles was observed by use of a scanning-type electron microscope (SEM), and the surface condition of the coated film was assessed in accordance with the following scale:

◎: Excellent

○: Good

Δ: Slightly poor x: Very poor

The results of the above-mentioned evaluations are shown in Table 4.

TABLE 4

| | Charge Quantity (μC/g) | | | Uniformity of | Spent Toner | | Uniformity of Coating |
|---|---|---|---|---|---|---|---|
| | At initial stage | After making 100,000 copies | After making 300,000 copies | Image Density (at initial stage) | After making 100,000 copies | After making 300,000 copies | Layer of Carrier Particles |
| Ex. III-1 | −25 | −23 | −21 | ◎ | ◎ | ◎ | ○ |
| Ex. III-2 | −24 | −22 | −21 | ◎ | ◎ | ◎ | ◎ |
| Ex. III-3 | −22 | −17 | −15 | ◎ | ○ | Δ | ◎ |
| Ex. III-4 | −21 | −17 | −15 | ◎ | ○ | Δ | ◎ |
| Ex. III-5 | −22 | −20 | −17 | ◎ | ◎ | ○ | ◎ |
| Ex. III-6 | −26 | −25 | −24 | ◎ | ◎ | ◎ | ○ |
| Ex. III-7 | −27 | −25 | −24 | ◎ | ◎ | ◎ | Δ |
| Ex. III-8 | −25 | −22 | −21 | ◎ | ◎ | ○ | Δ |
| Ex. III-9 | −25 | −23 | −21 | ◎ | ◎ | ○ | ○ |
| Ex. III-10 | −24 | −23 | −20 | ◎ | ◎ | ○ | ○ |
| Ex. III-11 | −20 | −17 | −15 | ◎ | ○ | Δ | ◎ |
| Ex. III-12 | −21 | −20 | −17 | ◎ | ◎ | ○ | ◎ |
| Ex. III-13 | −26 | −25 | −23 | ◎ | ◎ | ◎ | ◎ |
| Comp. Ex. III-1 | | | | Not subjected to evaluation. | | | |

As can be seen from the results shown in Table 4, the two-component developers comprising the carriers of the present invention show sufficiently stable charge quantity and excellent durability. In addition, the spent toner can be effectively prevented.

IV. Examples of Use of Electroconductive-Material-Containing Water-Soluble Resin Solution B

EXAMPLE IV-1

100 g of pure water and 5 g of carbon black were added to 100 of the synthetic resin solution (I-1) prepared in Preparation Example I-1 and the thus obtained mixture was dispersed in a homomixer, whereby a resin coating layer formation liquid for carrier particles was prepared.

The above prepared resin coating layer formation liquid and 1 kg of core particles (Trademark "F-150", made by Powder Tech Co., Ltd., with a particle diameter of 80 μm) were placed in a fluidized bed coating apparatus, and the surface of the core particles was coated with the resin coating layer formation liquid by the fluidized bed coating method.

The thus prepared resin coated particles were dried for about 5 minutes, and passed through a screen with mesh of 150 μm, whereby a carrier No. IV-1 according to the present invention was obtained.

EXAMPLE IV-2

The procedure for preparation of the carrier No. IV-1 in Example IV-1 was repeated except that the synthetic resin solution (I-1) in the coating layer formation liquid employed in Example IV-1 was replaced by the synthetic resin solution (I-2) prepared in Preparation Example I-2, whereby a carrier No. IV-2 according to the present invention was obtained.

EXAMPLE IV-3

The procedure for preparation of the carrier No. IV-1 in Example IV-1 was repeated except that the synthetic resin solution (I-1) in the coating layer formation liquid employed in Example IV-1 was replaced by the synthetic resin solution (I-5) prepared in Preparation Example I-5, whereby a carrier No. IV-3 according to the present invention was obtained.

EXAMPLE IV-4

The procedure for preparation of the carrier No. IV-1 in Example IV-1 was repeated except that the synthetic resin solution (I-1) in the coating layer formation liquid employed in Example IV-1 was replaced by the synthetic resin solution (I-6) prepared in Preparation Example I-6, whereby a carrier No. IV-4 according to the present invention was obtained.

EXAMPLE IV-5

The procedure for preparation of the carrier No. IV-1 in Example IV-1 was repeated except that the synthetic resin solution (I-1) in the coating layer formation liquid employed in Example IV-1 was replaced by the synthetic resin solution (I-7) prepared in Preparation Example I-7, whereby a carrier No. IV-5 according to the present invention was obtained.

EXAMPLE IV-6

The procedure for preparation of the carrier No. IV-1 in Example IV-1 was repeated except that the synthetic resin solution (I-1) in the coating layer formation liquid employed in Example IV-1 was replaced by the synthetic resin solution (I-8) prepared in Preparation Example I-8, whereby a carrier No. IV-6 according to the present invention was obtained.

EXAMPLE IV-7

The procedure for preparation of the carrier No. IV-1 in Example IV-1 was repeated except that the synthetic resin solution (I-1) in the coating layer formation liquid employed in Example IV-1 was replaced by the synthetic resin solution (I-9) prepared in Preparation Example I-9, whereby a carrier No. IV-7 according to the present invention was obtained.

EXAMPLE IV-8

The procedure for preparation of the carrier No. IV-1 in Example IV-1 was repeated except that the synthetic resin solution (I-1) in the coating layer formation liquid employed in Example IV-1 was replaced by the synthetic resin solution (I-10) prepared in Preparation Example I-10, whereby a carrier No. IV-8 according to the present invention was obtained.

EXAMPLE IV-9

The procedure for preparation of the carrier No. IV-1 in Example IV-1 was repeated except that the synthetic resin solution (I-1) in the coating layer formation liquid employed in Example IV-1 was replaced by the synthetic resin solution (I-11) prepared in Preparation Example I-11, whereby a carrier No. IV-9 according to the present invention was obtained.

EXAMPLE IV-10

The procedure for preparation of the carrier No. IV-1 in Example IV-1 was repeated except that the synthetic resin solution (I-1) in the coating layer formation liquid employed in Example IV-1 was replaced by the synthetic resin solution (I-12) prepared in Preparation Example I-12, whereby a carrier No. IV-10 according to the present invention was obtained.

EXAMPLE IV-11

The procedure for preparation of the carrier No. IV-1 in Example IV-1 was repeated except that the synthetic resin solution (I-1) in the coating layer formation liquid employed in Example IV-1 was replaced by the synthetic resin solution (I-13) prepared in Preparation Example I-13, whereby a carrier No. IV-11 according to the present invention was obtained.

EXAMPLE IV-12

The procedure for preparation of the carrier No. IV-1 in Example IV-1 was repeated except that the synthetic resin solution (I-1) in the coating layer formation liquid employed in Example IV-1 was replaced by the synthetic resin solution (I-14) prepared in Preparation Example I-14, whereby a carrier No. IV-12 according to the present invention was obtained.

EXAMPLE IV-13

The procedure for preparation of the carrier No. IV-2 in Example IV-2 was repeated except that the coated carrier particles obtained in Example IV-2 were further subjected to heat treatment of 160° C. for 30 minutes after drying process, whereby a carrier No. IV-13 according to the present invention was obtained.

EXAMPLE IV-14

The procedure for preparation of the carrier No. IV-2 in Example IV-2 was repeated except that the coated carrier particles obtained in Example IV-2 were further subjected to heat treatment of 130° C. for 30 minutes after drying process, whereby a carrier No. IV-14 according to the present invention was obtained.

Comparative Example IV-1

The procedure for preparation of the carrier No. IV-1 in Example IV-1 was repeated except that the synthetic resin solution (I-1) in the coating layer formation liquid employed in Example IV-1 was replaced by the synthetic resin solution (I-4) prepared in Preparation Example I-4, whereby a comparative carrier No. IV-1 was obtained.

By use of each of the carriers No. IV-1 to No. IV-14 according to the present invention and the comparative carrier No. IV-1, two-component developers were prepared in such a manner that 97 parts by weight of each carrier and 3 parts by weight of the previously obtained toner A were mixed in a ball mill.

Each of the thus obtained two-component developers was subjected to an image formation test in such a manner that the developer was incorporated in a commercially available copying machine (Trademark "FT-6960L", made by Ricoh Company, Ltd.), and 300,000 copies were made.

Then, the following evaluations were carried out:

(1) Charge quantity

The charge quantities of the toner were measured by the blow-off method at the time of making a first copy, and after making 300,000 copies.

(2) Spent phenomenon

The degree of spent toner (S) was obtained after making 300,000 copies by the same method and assessed in accordance with the same scale as previously explained.

(3) Uniformity of image density

The difference between the maximum value of the image density and the minimum value thereof was obtained by the same method as previously explained, and the uniformity of the image density was assessed in accordance with the same scale.

(4) Uniformity of coating layer of carrier particles

The surface of the carrier particles was observed by use of a scanning-type electron microscope (SEM), and the uniformity of the coating layer of carrier particles was assessed in accordance with the following scale:

⊙: Excellent

○: Good

Δ: Slightly poor x: Very poor (5) Aggregation of carrier particles

The weight ($W_1$) of the fabricated carrier was measured. This carrier was passed through a screen with a mesh of 150 μm (specified in the Japanese Industrial Standard JIS Z 8801), and the weight ($W_2$) of the carrier remaining on the screen was measured. The aggregation ratio of the carrier particles was calculated in accordance with the following formula:

$$\text{Aggregation ratio of carrier (\%)}=(W_1-W_2)\times 100$$

(6) Peeling of coating layer of carrier particles

Peeling of the coating layer from the carrier core particles was observed, and the peeling degree was assessed in accordance with the same scale as previously explained.

The results of the above-mentioned evaluations are shown in Table 5.

TABLE 5

| | Charge Quantity (μC/g) | | | | Uniformity of Coating | Aggregation | |
|---|---|---|---|---|---|---|---|
| | At initial stage | After making 300,000 copies | Spent Toner | Uniformity of Image Density | Layer of Carrier Particles | Ratio of Carrier Particles | Peeling of Coating Layer |
| Ex. IV-1 | −21.3 | −16.5 | ○ | ⊙ | ⊙ | 2.5 | ○ |
| Ex. IV-2 | −22.0 | −18.1 | ○ | ⊙ | ○ | 2.8 | ○ |
| Ex. IV-3 | −17.0 | −14.0 | ○ | ⊙ | ⊙ | 2.4 | ○ |
| Ex. IV-4 | −24.2 | −19.1 | ○ | ⊙ | ⊙ | 2.6 | ○ |
| Ex. IV-5 | −20.1 | −15.0 | ○ | ⊙ | ⊙ | 2.2 | ○ |
| Ex. IV-6 | −18.7 | −11.0 | Δ | ⊙ | ⊙ | 1.3 | ⊙ |

TABLE 5-continued

| | Charge Quantity (μC/g) | | | | Uniformity of Coating | Aggregation | |
|---|---|---|---|---|---|---|---|
| | At initial stage | After making 300,000 copies | Spent Toner | Uniformity of Image Density | Layer of Carrier Particles | Ratio of Carrier Particles | Peeling of Coating Layer |
| Ex. IV-7 | −22.2 | −16.6 | ○ | ◎ | ○ | 3.9 | Δ |
| Ex. IV-8 | −20.3 | −12.7 | ○ | ◎ | Δ | 4.9 | Δ |
| Ex. IV-9 | −24.4 | −20.2 | ○ | ◎ | ○ | 2.7 | ◎ |
| Ex. IV-10 | −22.2 | −19.1 | ○ | ◎ | ○ | 2.9 | ◎ |
| Ex. IV-11 | −23.1 | −19.8 | ○ | ◎ | ○ | 2.9 | ○ |
| Ex. IV-12 | −24.7 | −17.1 | ○ | ◎ | Δ | 3.1 | ○ |
| Ex. IV-13 | −19.2 | −17.0 | ◎ | ◎ | ◎ | 2.8 | ○ |
| Ex. IV-14 | −22.3 | −20.3 | ○ | ◎ | ○ | 2.8 | ○ |
| Comp. Ex. IV-1 | −20.5 | −10.1 | x | x | ◎ | 0.5 | ◎ |

As can be seen from the results shown in Table 5, the carriers according to the present invention can be easily produced with a high yield, and the two-component developers comprising the carriers of the present invention show sufficiently stable charge quantity and excellent durability.

Japanese Patent Application No. 6-329815 filed Dec. 6, 1994 and Japanese Patent Application filed Nov. 29, 1995 are hereby incorporated by reference.

What is claimed is:

1. A carrier for a dry two-component developer, comprising a core material and a silicone-modified acrylic resin layer coated on the surface of said core material, said silicone-modified acrylic resin layer comprising a silicone-modified acrylic resin, with the ratio of the percentage transmission of infrared spectrum Si—O stretching vibrations ($T_{Si}$) of said silicone-modified acrylic resin layer to the percentage transmission of infrared spectrum C=O stretching vibrations ($T_C$) thereof, $T_{Si}/T_C$, being at least 1.0.

2. A carrier for a dry two-component developer, comprising a core material and a silicone-modified acrylic resin layer coated on the surface of said core material, said silicone-modified acrylic resin layer comprising a silicone-modified acrylic resin which is made from a water-soluble synthetic resin solution comprising a silicone macromonomer (A) with a vinyl group being introduced into one terminal thereof, and a vinyl monomer (B) which is copolymerizable with said silicone macromonomer (A), with the molecular weight of said silicone macromonomer (A) of said silicone-modified acrylic resin being in the range of 1,000 to 10,000.

3. The carrier for a dry two-component developer as claimed in claim 1, wherein said silicone-modified acrylic resin for said silicone-modified acrylic resin layer is made from a water-soluble synthetic resin solution comprising a silicone macromonomer (A) with a vinyl group being introduced into one terminal thereof, and a vinyl monomer (B) which is copolymerizable with said silicone macromonomer (A), with the molecular weight of said silicone macromonomer (A) of said silicone-modified acrylic resin being in the range of 1,000 to 10,000.

4. The carrier for a dry two-component developer as claimed in claim 2, wherein said silicone-modified acrylic resin for said silicone-modified acrylic resin layer is made with said silicone macromonomer (A) and said vinyl monomer (B) being mixed with a parts-by-weight ratio in the range of (40:60) to (70:30).

5. The carrier for a dry two-component developer as claimed in claim 3, wherein said silicone-modified acrylic resin for said silicone-modified acrylic resin layer is made with said silicone macromonomer (A) and said vinyl monomer (B) being mixed with a parts-by-weight ratio in the range of (40:60) to (70:30).

6. The carrier for a dry two-component developer as claimed in claim 2, wherein said silicone-modified acrylic resin is further allowed to react with a water-soluble melamine resin by mixing said silicone-modified acrylic resin with said water-soluble melamine resin in a parts-by-weight ratio in the range of (100:2) to (100:5) for the formation of said silicone-modified acrylic resin layer.

7. The carrier for a dry two-component developer as claimed in claim 3, wherein said silicone-modified acrylic resin is further allowed to react with a water-soluble melamine resin by mixing said silicone-modified acrylic resin with said water-soluble melamine resin in a parts-by-weight ratio in the range of (100:2) to (100:5) for the formation of said silicone-modified acrylic resin layer.

8. The carrier for a dry two-component developer as claimed in claim 4, wherein said silicone-modified acrylic resin is further allowed to react with a water-soluble melamine resin by mixing said silicone-modified acrylic resin with said water-soluble melamine resin in a parts-by-weight ratio in the range of (100:2) to (100:5) for the formation of said silicone-modified acrylic resin layer.

9. The carrier for a dry two-component developer as claimed in claim 5, wherein said silicone-modified acrylic resin is further allowed to react with a water-soluble melamine resin by mixing said silicone-modified acrylic resin with said water-soluble melamine resin in a parts-by-weight ratio in the range of (100:2) to (100:5) for the formation of said silicone-modified acrylic resin layer.

10. A carrier for a dry two-component developer, comprising a core material and a silicone-modified acrylic resin layer coated on the surface of said core material, said silicone-modified acrylic resin layer being formed from an aqueous dispersion of synthetic resin particles, each particle comprising (1) a core layer comprising a polymer of a silicone macromonomer (A) with a vinyl group being introduced into one terminal thereof, and/or a vinyl monomer (B) which is copolymerizable with said silicone macromonomer (A), and (2) an outer shell which covers said core layer, comprising a copolymer of said silicone macromonomer (A) and said vinyl monomer (B) which is copolymerizable with said silicone macromonomer (A).

11. The carrier for a dry two-component developer as claimed in claim 1, wherein said silicone-modified acrylic resin layer is formed from an aqueous dispersion of synthetic resin particles, each particle comprising (1) a core layer comprising a polymer of a silicone macromonomer (A) with a vinyl group being introduced into one terminal thereof, and/or a vinyl monomer (B) which is copolymerizable with said silicone macromonomer (A), and (2) an outer shell which covers said core layer, comprising a copolymer of said silicone macromonomer (A) and said vinyl monomer (B) which is copolymerizable with said silicone macromonomer (A).

12. The carrier for a dry two-component developer as claimed in claim 10, wherein said core layer of said synthetic resin particles has a glass transition temperature which is higher than the glass transition temperature of said outer shell thereof.

13. The carrier for a dry two-component developer as claimed in claim 11, wherein said core layer of said synthetic resin particles has a glass transition temperature which is higher than the glass transition temperature of said outer shell thereof.

14. The carrier for a dry two-component developer as claimed in claim 10, wherein the amount of said silicone macromonomer (A) in said outer shell is in the range of 50 to 100 parts by weight to 100 parts by weight of the entire amount of said silicone macromonomer (A) contained in the entire weight of said polymer or said copolymer of which said core layer and said outer shell are made.

15. The carrier for a dry two-component developer as claimed in claim 11, wherein the amount of said silicone macromonomer (A) in said outer shell is in the range of 50 to 100 parts by weight to 100 parts by weight of the entire amount of said silicone macromonomer (A) contained in the entire weight of said polymer or said copolymer of which said core layer and said outer shell are made.

16. The carrier for a dry two-component developer as claimed in claim 12, wherein the amount of said silicone macromonomer (A) in said outer shell is in the range of 50 to 100 parts by weight to 100 parts by weight of the entire amount of said silicone macromonomer (A) contained in the entire weight of said polymer or said copolymer of which said core layer and said outer shell are made.

17. The carrier for a dry two-component developer as claimed in claim 13, wherein the amount of said silicone macromonomer (A) in said outer shell is in the range of 50 to 100 parts by weight to 100 parts by weight of the entire amount of said silicone macromonomer (A) contained in the entire weight of said polymer or said copolymer of which said core layer and said outer shell are made.

18. The carrier for a dry two-component developer as claimed in claim 10, wherein said silicone-modified acrylic resin is further allowed to react with a water-soluble melamine resin by mixing said silicone-modified acrylic resin with said water-soluble melamine resin in a parts-by-weight ratio in the range of (100:2) to (100:5) for the formation of said silicone-modified acrylic resin layer.

19. The carrier for a dry two-component developer as claimed in claim 11, wherein said silicone-modified acrylic resin is further allowed to react with a water-soluble melamine resin by mixing said silicone-modified acrylic resin with said water-soluble melamine resin in a parts-by-weight ratio in the range of (100:2) to (100:5) for the formation of said silicone-modified acrylic resin layer.

20. The carrier for a dry two-component developer as claimed in claim 12, wherein said silicone-modified acrylic resin is further allowed to react with a water-soluble melamine resin by mixing said silicone-modified acrylic resin with said water-soluble melamine resin in a parts-by-weight ratio in the range of (100:2) to (100:5) for the formation of said silicone-modified acrylic resin layer.

21. The carrier for a dry two-component developer as claimed in claim 13, wherein said silicone-modified acrylic resin is further allowed to react with a water-soluble melamine resin by mixing said silicone-modified acrylic resin with said water-soluble melamine resin in a parts-by-weight ratio in the range of (100:2) to (100:5) for the formation of said silicone-modified acrylic resin layer.

22. The carrier for a dry two-component developer as claimed in claim 14, wherein said silicone-modified acrylic resin is further allowed to react with a water-soluble melamine resin by mixing said silicone-modified acrylic resin with said water-soluble melamine resin in a parts-by-weight ratio in the range of (100:2) to (100:5) for the formation of said silicone-modified acrylic resin layer.

23. The carrier for a dry two-component developer as claimed in claim 15, wherein said silicone-modified acrylic resin is further allowed to react with a water-soluble melamine resin by mixing said silicone-modified acrylic resin with said water-soluble melamine resin in a parts-by-weight ratio in the range of (100:2) to (100:5) for the formation of said silicone-modified acrylic resin layer.

24. The carrier for a dry two-component developer as claimed in claim 16, wherein said silicone-modified acrylic resin is further allowed to react with a water-soluble melamine resin by mixing said silicone-modified acrylic resin with said water-soluble melamine resin in a parts-by-weight ratio in the range of (100:2) to (100:5) for the formation of said silicone-modified acrylic resin layer.

25. The carrier for a dry two-component developer as claimed in claim 17, wherein said silicone-modified acrylic resin is further allowed to react with a water-soluble melamine resin by mixing said silicone-modified acrylic resin with said water-soluble melamine resin in a parts-by-weight ratio in the range of (100:2) to (100:5) for the formation of said silicone-modified acrylic resin layer.

26. A carrier for a dry two-component developer, comprising a core material and a silicone-modified acrylic resin layer comprising a silicone-modified acrylic resin, which is coated on the surface of said core material, said silicone-modified acrylic resin being formed from:

an aqueous dispersion A of synthetic resin particles, each particle comprising (1) a core layer comprising a polymer of a silicone macromonomer (A) with a vinyl group being introduced into one terminal thereof, and/or a vinyl monomer (B) which is copolymeriz-able with said silicone macromonomer (A), and (2) an outer shell which covers said core layer, comprising a copolymer of said silicone macro-monomer (A) and said vinyl monomer (B) which is copolymerizable with said silicone macromonomer (A); and an aqueous resin solution B comprising a copolymer of said silicone macromonomer (A) and said vinyl monomer (B) which is copolymeriz-able with said silicone macromonomer (A), and said silicone-modified acrylic resin further comprising an electroconductive material.

27. The carrier for a dry two-component developer as claimed in claim 1, wherein said silicone-modified acrylic resin for said silicone-modified acrylic resin layer is formed from:

an aqueous dispersion A of synthetic resin particles, each particle comprising (1) a core layer comprising a polymer of a silicone macromonomer (A) with a vinyl group being introduced into one terminal thereof, and/or a vinyl monomer (B) which is copolymeriz-able with said silicone macromonomer (A), and (2) an outer shell which covers said core layer, comprising a copolymer of said silicone macro-monomer (A) and said vinyl monomer (B) which is copolymerizable with said silicone macromonomer (A); and an aqueous resin solution B comprising a copolymer of said silicone macromonomer (A) and said vinyl monomer (B) which is copolymeriz-able with said silicone macromonomer (A), and said silicone-modified acrylic resin further comprising an electroconductive material.

28. The carrier for a dry two-component developer as claimed in claim 26, wherein said aqueous dispersion A and/or said aqueous resin solution B further comprises a water-soluble melamine resin.

29. The carrier for a dry two-component developer as claimed in claim 27, wherein said aqueous dispersion A and/or said aqueous resin solution B further comprises a water-soluble melamine resin.

30. The carrier for a dry two-component developer as claimed in claim 26, wherein said silicone macromonomer contained in said aqueous dispersion A and/or said aqueous resin solution B comprises a polymethylene siloxane.

31. The carrier for a dry two-component developer as claimed in claim 27, wherein said silicone macromonomer contained in said aqueous dispersion A and/or said aqueous resin solution B comprises a polymethylene siloxane.

32. The carrier for a dry two-component developer as claimed in claim 28, wherein said silicone macromonomer contained in said aqueous dispersion A and/or said aqueous resin solution B comprises a polymethylene siloxane.

33. The carrier for a dry two-component developer as claimed in claim 29, wherein said silicone macromonomer contained in said aqueous dispersion A and/or said aqueous resin solution B comprises a polymethylene siloxane.

34. The carrier for a dry two-component developer as claimed in claim 26, wherein said silicone macromonomer contained in said aqueous dispersion A and/or said aqueous resin solution B has a molecular weight in the range of 1,000 to 20,000.

35. The carrier for a dry two-component developer as claimed in claim 27, wherein said silicone macromonomer contained in said aqueous dispersion A and/or said aqueous resin solution B has a molecular weight in the range of 1,000 to 20,000.

36. The carrier for a dry two-component developer as claimed in claim 28, wherein said silicone macromonomer contained in said aqueous dispersion A and/or said aqueous resin solution B has a molecular weight in the range of 1,000 to 20,000.

37. The carrier for a dry two-component developer as claimed in claim 29, wherein said silicone macromonomer contained in said aqueous dispersion A and/or said aqueous resin solution B has a molecular weight in the range of 1,000 to 20,000.

38. The carrier for a dry two-component developer as claimed in claim 30, wherein said silicone macromonomer contained in said aqueous dispersion A and/or said aqueous resin solution B has a molecular weight in the range of 1,000 to 20,000.

39. The carrier for a dry two-component developer as claimed in claim 31, wherein said silicone macromonomer contained in said aqueous dispersion A and/or said aqueous resin solution B has a molecular weight in the range of 1,000 to 20,000.

40. The carrier for a dry two-component developer as claimed in claim 32, wherein said silicone macromonomer contained in said aqueous dispersion A and/or said aqueous resin solution B has a molecular weight in the range of 1,000 to 20,000.

41. The carrier for a dry two-component developer as claimed in claim 33, wherein said silicone macromonomer contained in said aqueous dispersion A and/or said aqueous resin solution B has a molecular weight in the range of 1,000 to 20,000.

42. The carrier for a dry two-component developer as claimed in claim 26, wherein said core layer of said synthetic resin particles has a glass transition temperature which is higher by at least 10° C. than the glass transition temperature of said outer shell thereof in said aqueous dispersion A.

43. The carrier for a dry two-component developer as claimed in claim 27, wherein said core layer of said synthetic resin particles has a glass transition temperature which is higher by at least 10° C. than the glass transition temperature of said outer shell thereof in said aqueous dispersion A.

44. The carrier for a dry two-component developer as claimed in claim 28, wherein said core layer of said synthetic resin particles has a glass transition temperature which is higher by at least 10° C. than the glass transition temperature of said outer shell thereof in said aqueous dispersion A.

45. The carrier for a dry two-component developer as claimed in claim 29, wherein said core layer of said synthetic resin particles has a glass transition temperature which is higher by at least 10° C. than the glass transition temperature of said outer shell thereof in said aqueous dispersion A.

46. The carrier for a dry two-component developer as claimed in claim 30, wherein said core layer of said synthetic resin particles has a glass transition temperature which is higher by at least 10° C. than the glass transition temperature of said outer shell thereof in said aqueous dispersion A.

47. The carrier for a dry two-component developer as claimed in claim 31, wherein said core layer of said synthetic resin particles has a glass transition temperature which is higher by at least 10° C. than the glass transition temperature of said outer shell thereof in said aqueous dispersion A.

48. The carrier for a dry two-component developer as claimed in claim 32, wherein said core layer of said synthetic resin particles has a glass transition temperature which is higher by at least 10° C. than the glass transition temperature of said outer shell thereof in said aqueous dispersion A.

49. The carrier for a dry two-component developer as claimed in claim 33, wherein said core layer of said synthetic resin particles has a glass transition temperature which is higher by at least 10° C. than the glass transition temperature of said outer shell thereof in said aqueous dispersion A.

50. The carrier for a dry two-component developer as claimed in claim 34, wherein said core layer of said synthetic resin particles has a glass transition temperature which is higher by at least 10° C. than the glass transition temperature of said outer shell thereof in said aqueous dispersion A.

51. The carrier for a dry two-component developer as claimed in claim 35, wherein said core layer of said synthetic resin particles has a glass transition temperature which is higher by at least 10° C. than the glass transition temperature of said outer shell thereof in said aqueous dispersion A.

52. The carrier for a dry two-component developer as claimed in claim 36, wherein said core layer of said synthetic resin particles has a glass transition temperature which is higher by at least 10° C. than the glass transition temperature of said outer shell thereof in said aqueous dispersion A.

53. The carrier for a dry two-component developer as claimed in claim 37, wherein said core layer of said synthetic resin particles has a glass transition temperature which is higher by at least 10° C. than the glass transition temperature of said outer shell thereof in said aqueous dispersion A.

54. The carrier for a dry two-component developer as claimed in claim 38, wherein said core layer of said synthetic resin particles has a glass transition temperature which is higher by at least 10° C. than the glass transition temperature of said outer shell thereof in said aqueous dispersion A.

55. The carrier for a dry two-component developer as claimed in claim 39, wherein said core layer of said synthetic resin particles has a glass transition temperature which is higher by at least 10° C. than the glass transition temperature of said outer shell thereof in said aqueous dispersion A.

56. The carrier for a dry two-component developer as claimed in claim 40, wherein said core layer of said synthetic resin particles has a glass transition temperature which is higher by at least 10° C. than the glass transition temperature of said outer shell thereof in said aqueous dispersion A.

57. The carrier for a dry two-component developer as claimed in claim 41, wherein said core layer of said synthetic resin particles has a glass transition temperature which is higher by at least 10° C. than the glass transition temperature of said outer shell thereof in said aqueous dispersion A.

58. The carrier for a dry two-component developer as claimed in claim 26, wherein the amount of said silicone macromonomer (A) in said outer shell in said synthetic resin particles contained in said aqueous dispersion A is in the range of 50 to 100 parts by weight to 100 parts by weight of the entire amount of said silicone macromonomer (A) contained in the entire weight of said synthetic resin particles.

59. The carrier for a dry two-component developer as claimed in claim 27, wherein the amount of said silicone macromonomer (A) in said outer shell in said synthetic resin particles contained in said aqueous dispersion A is in the range of 50 to 100 parts by weight to 100 parts by weight of the entire amount of said silicone macromonomer (A) contained in the entire weight of said synthetic resin particles.

60. The carrier for a dry two-component developer as claimed in claim 28, wherein the amount of said silicone macromonomer (A) in said outer shell in said synthetic resin particles contained in said aqueous dispersion A is in the range of 50 to 100 parts by weight to 100 parts by weight of the entire amount of said silicone macromonomer (A) contained in the entire weight of said synthetic resin particles.

61. The carrier for a dry two-component developer as claimed in claim 29, wherein the amount of said silicone macromonomer (A) in said outer shell in said synthetic resin particles contained in said aqueous dispersion A is in the range of 50 to 100 parts by weight to 100 parts by weight of the entire amount of said silicone macromonomer (A) contained in the entire weight of said synthetic resin particles.

62. The carrier for a dry two-component developer as claimed in claim 30, wherein the amount of said silicone macromonomer (A) in said outer shell in said synthetic resin particles contained in said aqueous dispersion A is in the range of 50 to 100 parts by weight to 100 parts by weight of the entire amount of said silicone macromonomer (A) contained in the entire weight of said synthetic resin particles.

63. The carrier for a dry two-component developer as claimed in claim 31, wherein the amount of said silicone macromonomer (A) in said outer shell in said synthetic resin particles contained in said aqueous dispersion A is in the range of 50 to 100 parts by weight to 100 parts by weight of the entire amount of said silicone macromonomer (A) contained in the entire weight of said synthetic resin particles.

64. The carrier for a dry two-component developer as claimed in claim 32, wherein the amount of said silicone macromonomer (A) in said outer shell in said synthetic resin particles contained in said aqueous dispersion A is in the range of 50 to 100 parts by weight to 100 parts by weight of the entire amount of said silicone macromonomer (A) contained in the entire weight of said synthetic resin particles.

65. The carrier for a dry two-component developer as claimed in claim 33, wherein the amount of said silicone macromonomer (A) in said outer shell in said synthetic resin particles contained in said aqueous dispersion A is in the range of 50 to 100 parts by weight to 100 parts by weight of the entire amount of said silicone macromonomer (A) contained in the entire weight of said synthetic resin particles.

66. The carrier for a dry two-component developer as claimed in claim 34, wherein the amount of said silicone macromonomer (A) in said outer shell in said synthetic resin particles contained in said aqueous dispersion A is in the range of 50 to 100 parts by weight to 100 parts by weight of the entire amount of said silicone macromonomer (A) contained in the entire weight of said synthetic resin particles.

67. The carrier for a dry two-component developer as claimed in claim 35, wherein the amount of said silicone macromonomer (A) in said outer shell in said synthetic resin particles contained in said aqueous dispersion A is in the range of 50 to 100 parts by weight to 100 parts by weight of the entire amount of said silicone macromonomer (A) contained in the entire weight of said synthetic resin particles.

68. The carrier for a dry two-component developer as claimed in claim 36, wherein the amount of said silicone macromonomer (A) in said outer shell in said synthetic resin particles contained in said aqueous dispersion A is in the range of 50 to 100 parts by weight to 100 parts by weight of the entire amount of said silicone macromonomer (A) contained in the entire weight of said synthetic resin particles.

69. The carrier for a dry two-component developer as claimed in claim 37, wherein the amount of said silicone macromonomer (A) in said outer shell in said synthetic resin particles contained in said aqueous dispersion A is in the range of 50 to 100 parts by weight to 100 parts by weight of the entire amount of said silicone macromonomer (A) contained in the entire weight of said synthetic resin particles.

70. The carrier for a dry two-component developer as claimed in claim 38, wherein the amount of said silicone macromonomer (A) in said outer shell in said synthetic resin particles contained in said aqueous dispersion A is in the range of 50 to 100 parts by weight to 100 parts by weight of the entire amount of said silicone macromonomer (A) contained in the entire weight of said synthetic resin particles.

71. The carrier for a dry two-component developer as claimed in claim 39, wherein the amount of said silicone macromonomer (A) in said outer shell in said synthetic resin particles contained in said aqueous dispersion A is in the range of 50 to 100 parts by weight to 100 parts by weight of the entire amount of said silicone macromonomer (A) contained in the entire weight of said synthetic resin particles.

72. The carrier for a dry two-component developer as claimed in claim 40, wherein the amount of said silicone macromonomer (A) in said outer shell in said synthetic resin particles contained in said aqueous dispersion A is in the range of 50 to 100 parts by weight to 100 parts by weight of the entire amount of said silicone macromonomer (A) contained in the entire weight of said synthetic resin particles.

73. The carrier for a dry two-component developer as claimed in claim 41, wherein the amount of said silicone macromonomer (A) in said outer shell in said synthetic resin particles contained in said aqueous dispersion A is in the range of 50 to 100 parts by weight to 100 parts by weight of the entire amount of said silicone macromonomer (A) contained in the entire weight of said synthetic resin particles.

74. The carrier for a dry two-component developer as claimed in claim 42, wherein the amount of said silicone macromonomer (A) in said outer shell in said synthetic resin particles contained in said aqueous dispersion A is in the range of 50 to 100 parts by weight to 100 parts by weight of the entire amount of said silicone macromonomer (A) contained in the entire weight of said synthetic resin particles.

75. The carrier for a dry two-component developer as claimed in claim 43, wherein the amount of said silicone macromonomer (A) in said outer shell in said synthetic resin particles contained in said aqueous dispersion A is in the range of 50 to 100 parts by weight to 100 parts by weight of the entire amount of said silicone macromonomer (A) contained in the entire weight of said synthetic resin particles.

76. The carrier for a dry two-component developer as claimed in claim 44, wherein the amount of said silicone macromonomer (A) in said outer shell in said synthetic resin particles contained in said aqueous dispersion A is in the range of 50 to 100 parts by weight to 100 parts by weight of the entire amount of said silicone macromonomer (A) contained in the entire weight of said synthetic resin particles.

77. The carrier for a dry two-component developer as claimed in claim 45, wherein the amount of said silicone macromonomer (A) in said outer shell in said synthetic resin particles contained in said aqueous dispersion A is in the range of 50 to 100 parts by weight to 100 parts by weight of the entire amount of said silicone macromonomer (A) contained in the entire weight of said synthetic resin particles.

78. The carrier for a dry two-component developer as claimed in claim 46, wherein the amount of said silicone macromonomer (A) in said outer shell in said synthetic resin particles contained in said aqueous dispersion A is in the range of 50 to 100 parts by weight to 100 parts by weight of the entire amount of said silicone macromonomer (A) contained in the entire weight of said synthetic resin particles.

79. The carrier for a dry two-component developer as claimed in claim 47, wherein the amount of said silicone macromonomer (A) in said outer shell in said synthetic resin particles contained in said aqueous dispersion A is in the range of 50 to 100 parts by weight to 100 parts by weight of the entire amount of said silicone macromonomer (A) contained in the entire weight of said synthetic resin particles.

80. The carrier for a dry two-component developer as claimed in claim 48, wherein the amount of said silicone macromonomer (A) in said outer shell in said synthetic resin particles contained in said aqueous dispersion A is in the range of 50 to 100 parts by weight to 100 parts by weight of the entire amount of said silicone macromonomer (A) contained in the entire weight of said synthetic resin particles.

81. The carrier for a dry two-component developer as claimed in claim 49, wherein the amount of said silicone macromonomer (A) in said outer shell in said synthetic resin particles contained in said aqueous dispersion A is in the range of 50 to 100 parts by weight to 100 parts by weight of the entire amount of said silicone macromonomer (A) contained in the entire weight of said synthetic resin particles.

82. The carrier for a dry two-component developer as claimed in claim 50, wherein the amount of said silicone macromonomer (A) in said outer shell in said synthetic resin particles contained in said aqueous dispersion A is in the range of 50 to 100 parts by weight to 100 parts by weight of the entire amount of said silicone macromonomer (A) contained in the entire weight of said synthetic resin particles.

83. The carrier for a dry two-component developer as claimed in claim 51, wherein the amount of said silicone macromonomer (A) in said outer shell in said synthetic resin particles contained in said aqueous dispersion A is in the range of 50 to 100 parts by weight to 100 parts by weight of the entire amount of said silicone macromonomer (A) contained in the entire weight of said synthetic resin particles.

84. The carrier for a dry two-component developer as claimed in claim 52, wherein the amount of said silicone macromonomer (A) in said outer shell in said synthetic resin particles contained in said aqueous dispersion A is in the range of 50 to 100 parts by weight to 100 parts by weight of the entire amount of said silicone macromonomer (A) contained in the entire weight of said synthetic resin particles.

85. The carrier for a dry two-component developer as claimed in claim 53, wherein the amount of said silicone macromonomer (A) in said outer shell in said synthetic resin particles contained in said aqueous dispersion A is in the range of 50 to 100 parts by weight to 100 parts by weight of the entire amount of said silicone macromonomer (A) contained in the entire weight of said synthetic resin particles.

86. The carrier for a dry two-component developer as claimed in claim 54, wherein the amount of said silicone macromonomer (A) in said outer shell in said synthetic resin particles contained in said aqueous dispersion A is in the range of 50 to 100 parts by weight to 100 parts by weight of the entire amount of said silicone macromonomer (A) contained in the entire weight of said synthetic resin particles.

87. The carrier for a dry two-component developer as claimed in claim 55, wherein the amount of said silicone macromonomer (A) in said outer shell in said synthetic resin particles contained in said aqueous dispersion A is in the range of 50 to 100 parts by weight to 100 parts by weight of the entire amount of said silicone macromonomer (A) contained in the entire weight of said synthetic resin particles.

88. The carrier for a dry two-component developer as claimed in claim 56, wherein the amount of said silicone macromonomer (A) in said outer shell in said synthetic resin particles contained in said aqueous dispersion A is in the range of 50 to 100 parts by weight to 100 parts by weight of the entire amount of said silicone macromonomer (A) contained in the entire weight of said synthetic resin particles.

89. The carrier for a dry two-component developer as claimed in claim 57, wherein the amount of said silicone macromonomer (A) in said outer shell in said synthetic resin particles contained in said aqueous dispersion A is in the range of 50 to 100 parts by weight to 100 parts by weight of the entire amount of said silicone macromonomer (A) contained in the entire weight of said synthetic resin particles.

90. A carrier for a dry two-component developer, comprising a core material and a silicone-modified acrylic resin layer coated on the surface of said core material, said silicone-modified acrylic resin layer comprising:

a silicone-modified acrylic resin which is made from a water-soluble synthetic resin solution comprising a silicone macromonomer (A) with a vinyl group being introduced into one terminal thereof, and a vinyl monomer (B) which is copolymerizable with said silicone macromonomer (A), with the molecular weight of said silicone macromonomer (A) of said silicone-modified acrylic resin being in the range of 1,000 to 10,000; and an electroconductive material.

91. The carrier for a dry two-component developer as claimed in claim 1, wherein said silicone-modified acrylic resin layer comprises:

a silicone-modified acrylic resin which is made from a water-soluble synthetic resin solution comprising a silicone macromonomer (A) with a vinyl group being introduced into one terminal thereof, and a vinyl monomer (B) which is copolymerizable with said silicone macromonomer (A), with the molecular weight of said silicone macromonomer (A) of said silicone-modified acrylic resin being in the range of 1,000 to 10,000; and an electroconductive material.

92. The carrier for a dry two-component developer as claimed in claim 90, wherein said silicone-modified acrylic resin for said silicone-modified acrylic resin layer is made with said silicone macromonomer (A) and said vinyl monomer (B) being mixed with a parts-by-weight ratio in the range of (40:60) to (70:30).

93. The carrier for a dry two-component developer as claimed in claim 91, wherein said silicone-modified acrylic resin for said silicone-modified acrylic resin layer is made with said silicone macromonomer (A) and said vinyl monomer (B) being mixed with a parts-by-weight ratio in the range of (40:60) to (70:30).

94. The carrier for a dry two-component developer as claimed in claim 90, wherein said silicone-modified acrylic resin is further allowed to react with a water-soluble melamine resin by mixing said silicone-modified acrylic resin with said water-soluble melamine resin in a parts-by-weight ratio in the range of (100:2) to (100:5) for the formation of said silicone-modified acrylic resin layer.

95. The carrier for a dry two-component developer as claimed in claim 91, wherein said silicone-modified acrylic resin is further allowed to react with a water-soluble melamine resin by mixing said silicone-modified acrylic resin with said water-soluble melamine resin in a parts-by-weight ratio in the range of (100:2) to (100:5) for the formation of said silicone-modified acrylic resin layer.

96. The carrier for a dry two-component developer as claimed in claim 92, wherein said silicone-modified acrylic resin is further allowed to react with a water-soluble melamine resin by mixing said silicone-modified acrylic resin with said water-soluble melamine resin in a parts-by-weight ratio in the range of (100:2) to (100:5) for the formation of said silicone-modified acrylic resin layer.

97. The carrier for a dry two-component developer as claimed in claim 93, wherein said silicone-modified acrylic resin is further allowed to react with a water-soluble melamine resin by mixing said silicone-modified acrylic resin with said water-soluble melamine resin in a parts-by-weight ratio in the range of (100:2) to (100:5) for the formation of said silicone-modified acrylic resin layer.

98. A method of producing a carrier for a dry two-component developer, said carrier comprising a core material and a silicone-modified acrylic resin layer coated on the surface of said core material, said silicone-modified acrylic resin layer comprising a silicone-modified acrylic resin and finely-divided electroconductive particles, comprising the steps (1) to (4) of:

(1) preparing a water-soluble silicone-modified acrylic resin solution B comprising a copolymer of a silicone macromonomer (A) with a vinyl group being introduced into one terminal thereof, and a vinyl monomer (B) which is copolymeriz-able with said silicone macromonomer (A);

(2) dispersing finely-divided electroconductive particles in said water-soluble silicone-modified acrylic resin solution B obtained in said step (1);

(3) preparing an aqueous dispersion A of synthetic resin particles, each particle comprising (1) a core layer comprising a polymer of said silicone macromonomer (A) and/or said vinyl monomer (B), and (2) an outer shell which covers said core layer, comprising a polymer of said silicone macromonomer (A) or a copolymer of said silicone macro-monomer (A) and said vinyl monomer (B) which is copolymerizable with said silicone macromonomer (A);

(4) mixing said aqueous dispersion A obtained in said step (3) with said water-soluble silicone-modified acrylic resin solution B which contains said finely-divided electroconductive particles, which is obtained in said step (2) to prepare a coating liquid for the formation of a silicone-modified acrylic resin layer; and coating the surface of said core material with said coating liquid obtained in said step (4).

99. The method of producing a carrier for a dry two-component developer as claimed in claim 98, further comprising a step (5) of subjecting the surface of said core material coated with said coating liquid obtained in step (4) to heat treatment at 150° C. or more.

100. A method of producing a carrier for a dry two-component developer, said carrier comprising a core material and a silicone-modified acrylic resin layer coated on the surface of said core material, said silicone-modified acrylic resin layer comprising a silicone-modified acrylic resin, with the ratio of the percentage transmission of infrared spectrum Si—O stretching vibrations ($T_{Si}$) of said silicone-modified acrylic resin layer to the percentage transmission of infrared spectrum C=O stretching vibrations ($T_C$) thereof, $T_{Si}/T_C$, being at least 1.0, comprising the steps of:

coating the surface of said core material with said silicone-modified acrylic resin; and subjecting the surface of said core material coated with said silicone-modified acrylic resin to heat treatment at 150° C. or more.

101. A method of producing a carrier for a dry two-component developer, said carrier comprising a core material and a silicone-modified acrylic resin layer coated on the surface of said core material, said silicone-modified acrylic resin layer comprising a silicone-modified acrylic resin which is made from a water-soluble synthetic resin solution comprising a silicone macromonomer (A) with a vinyl group being introduced into one terminal thereof, and a vinyl monomer (B) which is copolymerizable with said silicone macromonomer (A), with the molecular weight of said silicone macromonomer (A) of said silicone-modified acrylic resin being in the range of 1,000 to 10,000, comprising the steps of:

coating the surface of said core material with said silicone-modified acrylic resin; and subjecting the surface of said core material coated with said silicone-modified acrylic resin to heat treatment at 150° C. or more.

102. A method of producing a carrier for a dry two-component developer, said carrier comprising a core material and a silicone-modified acrylic resin layer coated on the surface of said core material, said silicone-modified acrylic resin layer being formed from an aqueous dispersion of synthetic resin particles, each particle comprising (1) a core layer comprising a polymer of a silicone macromonomer (A) with a vinyl group being introduced into one terminal thereof, and/or a vinyl monomer (B) which is copolymerizable with said silicone macromonomer (A), and (2) an outer shell which covers said core layer, comprising a copolymer of said silicone macromonomer (A) and said vinyl monomer (B) which is copolymerizable with said silicone macromonomer (A), comprising the steps of:

coating the surface of said core material with said silicone-modified acrylic resin; and subjecting the surface of said core material coated with said silicone-modified acrylic resin to heat treatment at 150° C. or more.

103. A method of producing a carrier for a dry two-component developer, said carrier comprising a core material and a silicone-modified acrylic resin layer comprising a silicone-modified acrylic resin, which is coated on the surface of said core material, said silicone-modified acrylic resin being formed from:

an aqueous dispersion A of synthetic resin particles, each particle comprising (1) a core layer comprising a polymer of a silicone macromonomer (A) with a vinyl group being introduced into one terminal thereof, and/or a vinyl monomer (B) which is copolymeriz-able with said silicone macromonomer (A), and (2) an outer shell which covers said core layer, comprising a copolymer of said silicone macro-monomer (A) and said vinyl monomer (B) which is copolymerizable with said silicone macromonomer (A); and an aqueous resin solution B comprising a copolymer of said silicone macromonomer (A) and said vinyl monomer (B) which is copolymeriz-able with said silicone macromonomer (A), and said silicone-modified acrylic resin further comprising an electroconductive material, comprising the steps of:

coating the surface of said core material with said silicone-modified acrylic resin; and subjecting the surface of said core material coated with said silicone-modified acrylic resin to heat treatment at 150° C. or more.

104. A method of producing a carrier for a dry two-component developer, said carrier comprising a core material and a silicone-modified acrylic resin layer coated on the surface of said core material, said silicone-modified acrylic resin layer comprising:

a silicone-modified acrylic resin which is made from a water-soluble synthetic resin solution comprising a silicone macromonomer (A) with a vinyl group being introduced into one terminal thereof, and a vinyl monomer (B) which is copolymerizable with said silicone macromonomer (A), with the molecular weight of said silicone macromonomer (A) of said silicone-modified acrylic resin being in the range of 1,000 to 10,000; and an electroconductive material, comprising the steps of:

coating the surface of said core material with said silicone-modified acrylic resin; and subjecting the surface of said core material coated with said silicone-modified acrylic resin to heat treatment at 150° C. or more.

* * * * *

UNITED STATES PATENT AND TRADEMARK OFFICE

CERTIFICATE OF CORRECTION

PATENT NO. : 5,652,079

DATED : July 29, 1997

INVENTOR(S) : Satoshi MOCHIZUKI ET AL

It is certified that error appears in the above-indentified patent and that said Letters Patent is hereby corrected as shown below:

Column 3, line 67 "an" should read --a--.

Column 8, line 49 "end/or" should read --and/or--.

line 54 "an" should read --a--.

Column 9, line 20 "be" should read --B--.

line 32 "an" should read --a--.

Column 16, line 6 "As" should read --A--.

line 41 "employs" should read --employed--.

Column 17, line 23, "he" should read --be--.

Column 24, line 67 "were" should read --was--.

Signed and Sealed this

Twenty-third Day of June, 1998

*Attest:*

Bruce Lehman

BRUCE LEHMAN

*Attesting Officer*

*Commissioner of Patents and Trademarks*